US006564600B1

(12) United States Patent
Davis

(10) Patent No.: US 6,564,600 B1
(45) Date of Patent: May 20, 2003

(54) ELECTRONIC ACCESS CONTROL DEVICE

(75) Inventor: Paul R. Davis, Corvallis, OR (US)

(73) Assignee: Videx, Inc., Corvallis, OR (US)

( * ) Notice: Subject to any disclaimer, the term of this patent is extended or adjusted under 35 U.S.C. 154(b) by 0 days.

(21) Appl. No.: 09/499,556

(22) Filed: Feb. 7, 2000

Related U.S. Application Data

(63) Continuation-in-part of application No. 09/264,246, filed on Mar. 8, 1999, now abandoned.

(51) Int. Cl.[7] ..... E05B 47/06

(52) U.S. Cl. ..... 70/277; 70/278.2; 70/278.7; 70/283

(58) Field of Search ..... 70/277, 432, 278.1, 70/278.2, 278.3, 283, 283.1, 279.1, 278.7

(56) References Cited

U.S. PATENT DOCUMENTS

| | | | | |
|---|---|---|---|---|
| 2,212,251 A | * | 8/1940 | Seelinger | |
| 2,271,966 A | * | 2/1942 | Baribault | |
| 2,475,220 A | * | 7/1949 | Chaulk et al. | |
| 2,763,888 A | | 9/1956 | Billeter | |
| 3,241,344 A | * | 3/1966 | Peters | |
| 3,731,963 A | | 5/1973 | Pond | 292/144 |
| 3,733,861 A | * | 5/1973 | Lester | 70/153 |
| 3,843,174 A | | 10/1974 | Bogunovich et al. | 292/166 |
| 4,099,752 A | | 7/1978 | Geringer | 292/144 |
| 4,127,966 A | | 12/1978 | Schmidt | 49/141 |
| 4,148,092 A | * | 4/1979 | Martin | 70/149 X |
| 4,262,504 A | | 4/1981 | Inoue | 70/151 R |
| 4,557,121 A | | 12/1985 | Charlton | 70/129 X |
| 4,579,376 A | | 4/1986 | Charton | 292/144 |
| 4,702,094 A | | 10/1987 | Peterson | 70/241 |
| 4,789,859 A | * | 12/1988 | Clarkson et al. | 361/172 X |
| 4,982,587 A | * | 1/1991 | Tzou | 70/492 |
| 5,010,751 A | * | 4/1991 | Schwartz et al. | 70/276 |
| 5,177,988 A | | 1/1993 | Bushnell | 70/175 X |
| 5,216,909 A | | 6/1993 | Armoogam | 70/283 X |
| 5,339,662 A | | 8/1994 | Goldman | 70/432 X |
| 5,421,178 A | | 6/1995 | Hamel et al. | 70/283 |
| 5,609,051 A | | 3/1997 | Donaldson | 70/303 A X |
| 5,819,563 A | * | 10/1998 | Bianco | 70/283 X |
| 5,878,612 A | * | 3/1999 | Mauer | 70/283 X |
| 6,064,316 A | * | 5/2000 | Glick et al. | 70/63 X |
| 6,082,153 A | * | 7/2000 | Schoell et al. | 70/1.5 |

FOREIGN PATENT DOCUMENTS

| | | | | |
|---|---|---|---|---|
| EP | 0148701 | * | 7/1985 | 70/283 |

* cited by examiner

*Primary Examiner*—Lloyd A. Gall
(74) *Attorney, Agent, or Firm*—Chernoff, Vilhauer, McClung & Stenzel, LLP

(57) ABSTRACT

An electronic access control device has a movable locking member. A locking mechanism is operable to control the locking member. A movement detector generates a first condition in response to movement of the locking member. A key detector generates a second condition in response to detecting a key. The locking mechanism increases resistance to movement of the locking member in response to the first condition, and decreases resistance to movement of the locking mechanism in response to the second condition.

16 Claims, 16 Drawing Sheets

16a
114
12
22
44
20
108
104
118
110
120
26
14
122
124
16b 114
12
22
20
102
44
116
108
104
116
118
120
44
14
122

ELECTRONIC ACCESS CONTROL DEVICE

This application is a continuation-in-part of U.S. patent application Ser. No. 09/264,246, filed Mar. 8, 1999, now abandoned.

BACKGROUND OF THE INVENTION

The present invention relates to an electronic access control device, and more particularly to an electronic lock having a solenoid which increases or decreases resistence to opening the lock.

Electronic locks are well known and have been used to control the functioning of a locking mechanism. In particular, solenoids have been used as part of an electronic lock to restrain a latch that prevents movement of a locking bolt. An example of such a system is shown in Nakauchi, U.S. Pat. No. 4,798,068. Electronic locks have the advantage of allowing the use of electronic keys, which enables such locks to keep track of different keys. However, electronic locks suffer from several disadvantages. First, the locks consume electrical power. Thus, such locks either must be connected to a permanent power source, or must be supplied with a battery. Often, it is not practical to connect an electronic lock to a permanent source of power. Power consumption by an electronic lock, however, can quickly deplete the power in the battery, requiring either large, bulky batteries or frequent replacement of batteries.

Electronic locks which use a solenoid suffer from another disadvantage in that such locks may be opened with a sharp blow to the lock. For example, in the electronic lock disclosed in Nakauchi U.S. Pat. No. 4,798,068, a magnet holds a latch in place, resisting the force of a spring which urges the latch toward an unlocked position. Such a locking mechanism may be unlocked by the expedient of a sharp blow to the outside of the lock. A sharp blow can jar the latch, causing the latch to move or become displaced from the magnet, and thus causing the latch to move to an open position.

Electronic locks may also be susceptible to picking. Electronic locks usually have openings to allow entry of an electronic key to open the lock. However, the openings in the electronic lock may provide access to the inside of the lock and allow the lock to be picked. It is further desirable to install electronic locks on existing cabinets and drawers. However, mounting the locks on the exterior surfaces of the doors may allow access to the mounting screws or bolts. The lock would then be susceptible to being removed from the cabinet or drawer by cutting or drilling out the screws or bolts which attach the lock to the drawer.

Electronic access control devices also can be difficult to use because of the necessity of storing key data within the device. Typically, such devices contain a memory which stores the key codes for electronic keys which are authorized to open the device. The key codes, however, must be entered into the memory. Over time, it may be desirable to update the memory, to add keys or to delete keys which are authorized to access the device. Updating the memory of the installed device to include the new information can be difficult and time consuming. This is typically carried out by connecting the electronic access control device to a computer, which then downloads the key access information to the memory of the electronic access control device. However, inputting the updated key access information and then carrying a computer to the device to update lock information is burdensome and time consuming.

In addition, it is also desirable for each electronic access control device to have a master key which controls access to the device and which may be authorized to perform additional device functions. However, this requires initializing the memory with the master key code. If initialization occurs at the manufacturer, then the device and master key must be kept together and sold as a unit. If initialization occurs after the device is installed, then a computer must be connected to the memory to download the master key information. In either event, entering master key data and maintaining device and master key pairings can be time consuming and difficult.

What is therefore desired is an electronic access control device that utilizes low power, that is not susceptible to opening in response to sharp blows to the device, which does not present openings through which the device may be picked or through which the device mountings may be accessed, which is not easily removed from the exterior surface to which it is mounted and which provides a system for managing key authorization information which is easy to use.

BRIEF SUMMARY OF THE INVENTION

In a first separate preferred aspect of the invention, the present invention provides an electronic access control device having a movable locking member. A locking mechanism is operable to control the locking member. A movement detector generates a first condition in response to movement of the locking member. A key detector generates a second condition in response to detecting a key. The locking mechanism increases resistance to movement of the locking member in response to the first condition, and decreases resistance to movement of the locking mechanism in response to the second condition.

In a second separate preferred aspect of the invention, the electronic access control device has a control mechanism regulated by a computer system. A key detector generates different key codes in response to detecting at least some keys. A computer system stores a plurality of authorized key codes, the computer system being operable to regulate the control mechanism in response to an authorized key code. The computer system stores a master key code in response to a first key code received from the.key detector so that the first key detected by the key detector becomes a master key capable of controlling storage of the authorized key codes.

In a third separate preferred aspect of the invention, an electronic access control device has an enclosure comprised of at least a housing and a base member detachably matingly engageable with one another. The enclosure contains a locking mechanism to control a locking member having respective locked and open positions. The base member has mounting members that attach the base member to a surface. A catch mechanism cooperates with the housing and the base member to limit relative movement therebetween when the housing is matingly engaged with the base member to form the enclosure and the locking member is in the locked position.

The several aspects of the present invention provide at least one or more of the following advantages. The present invention provides an electronic access control device which utilizes only small amounts of power to operate the device. The electronic access control device is also more resistant to opening in response to a blow to the exterior of the device. The invention further provides an electronic access control device which is less susceptible to being picked. In addition, the electronic access control device provides greater protection to the mounting members to prevent removal of the mounting members of the device. Finally, the present invention provides an electronic access control device that enables easy management of keys which are authorized to actuate the device.

The foregoing and other features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
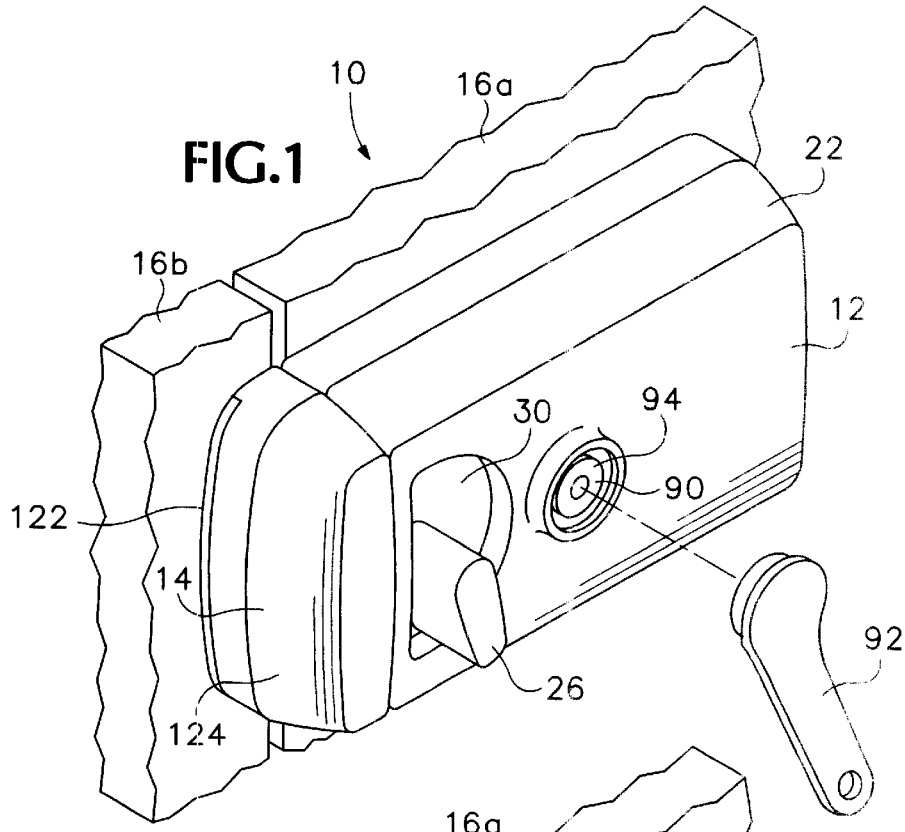
FIG. 1 shows a perspective view of an electronic access control device of the present invention mounted to the exterior of two adjoining surfaces.

Referring now to the drawings, wherein like numerals refer to like elements, in one preferred embodiment the present invention provides an electronic access control device such as an electronic lock 10 comprised of a lock unit 12 and a strike unit 14. FIG. 1 shows a perspective view of an exemplary embodiment of the electronic lock 10 mounted to surfaces 16*a* and 16*b*. The electronic lock 10 is suitable for use in a wide variety of environments, such as with cabinets, file drawers, doors, windows, desk drawers, chests, panels, or the like. In use, the lock unit 12 is mounted on one surface 16*a*, and the strike unit 14 is mounted on another surface 16*b*, so that when locked the lock unit 12 and strike unit 14 prevent movement of the two surfaces with respect to each other. Nevertheless, the various aspects of the present invention need not be incorporated into a surface mounted lock and may also be used in environments where the lock unit 12 and/or the strike unit 14 are recessed or embedded inside of a door or wall.

The Locking Mechanism

Figure 3A:
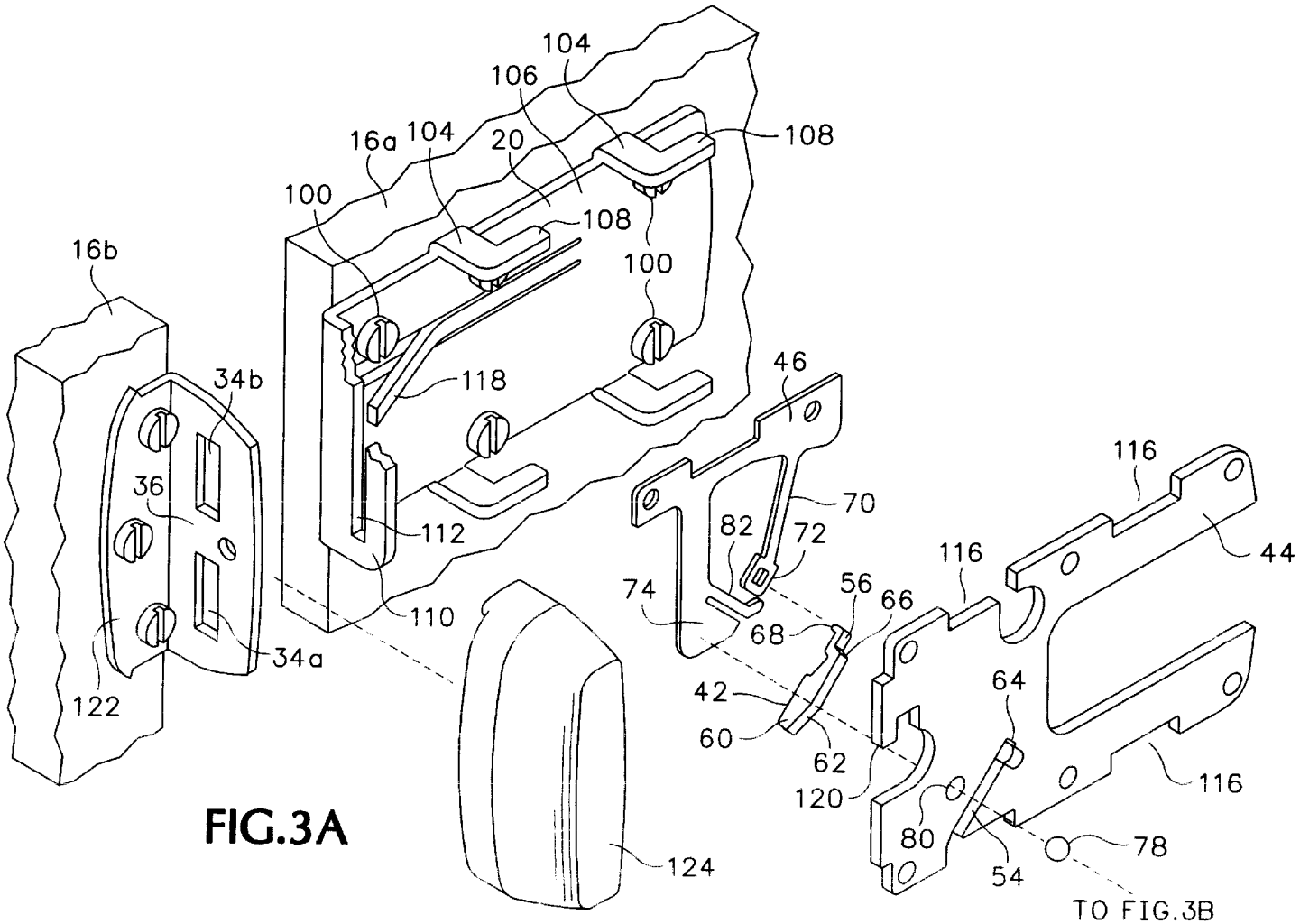
FIG. 3A shows an exploded view of several parts of the electronic access control device of FIG. 1.
Figure 3B:
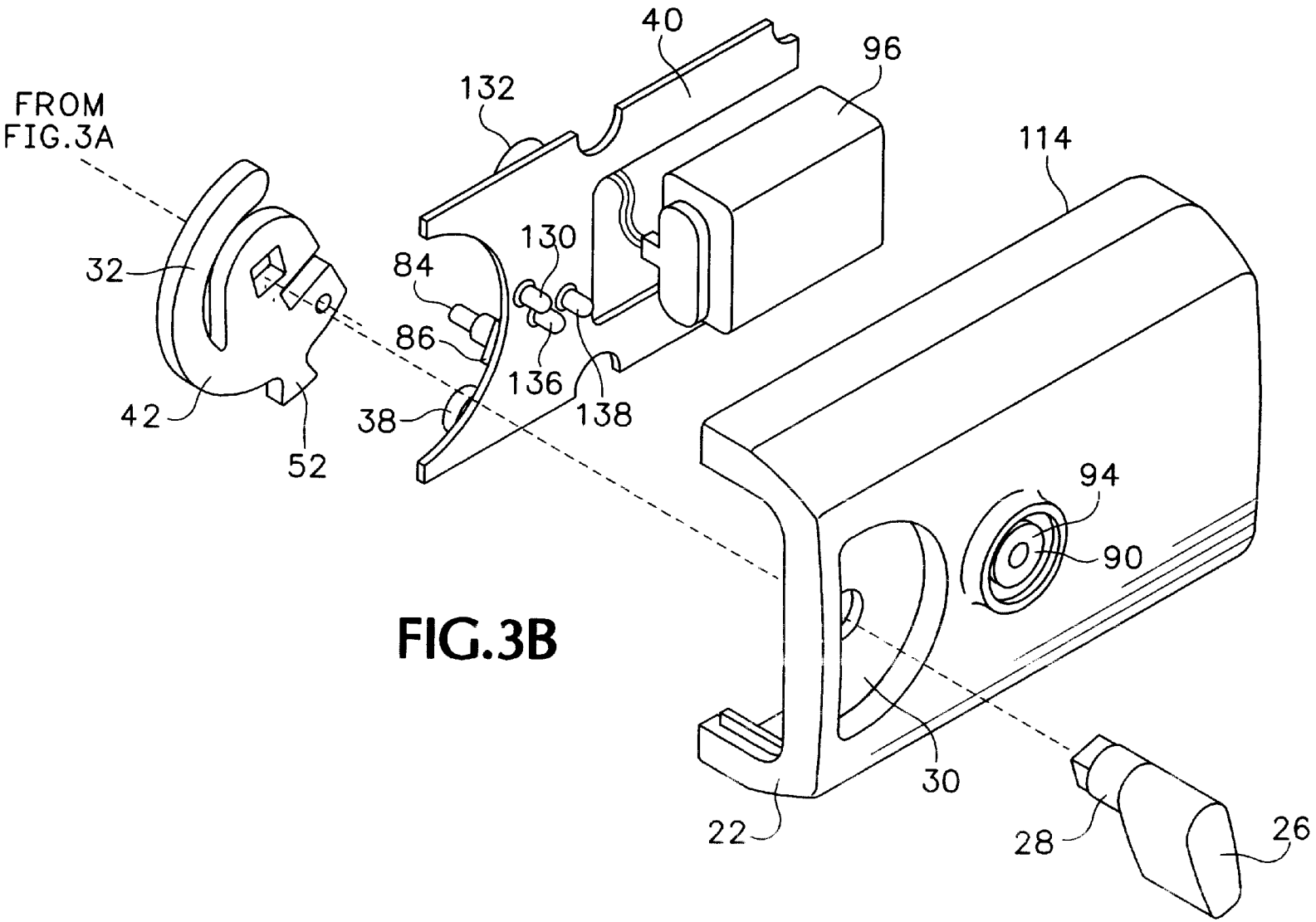
FIG. 3B shows an exploded view of the remaining parts of the electronic access control device of FIG. 1 not shown in FIG. 3A.

Referring now to FIGS. 3A and 3B, the lock unit 12 is comprised of a base member 20 and a housing 22. The lock unit 12 contains a locking member 24 which is movable between an open and a locked position. In the open position, the locking member 24 is recessed within the housing 22. In the locked position, the locking member 24 extends out of the housing 22 and is operable with the strike unit 14 to secure the lock unit 12 relative to the strike unit 14.

A knob 26 is connected to a shaft 28 which passes through the housing 22 and is connected to the locking member 24. Rotation of the knob 26 causes the locking member 24 to rotate from the open to the locked position. The top of the housing 22 has a recess 30 in which the knob 26 rotates, but alternatively the knob 26 may be mounted flush with the top exterior surface of the housing 22.

Figure 2:
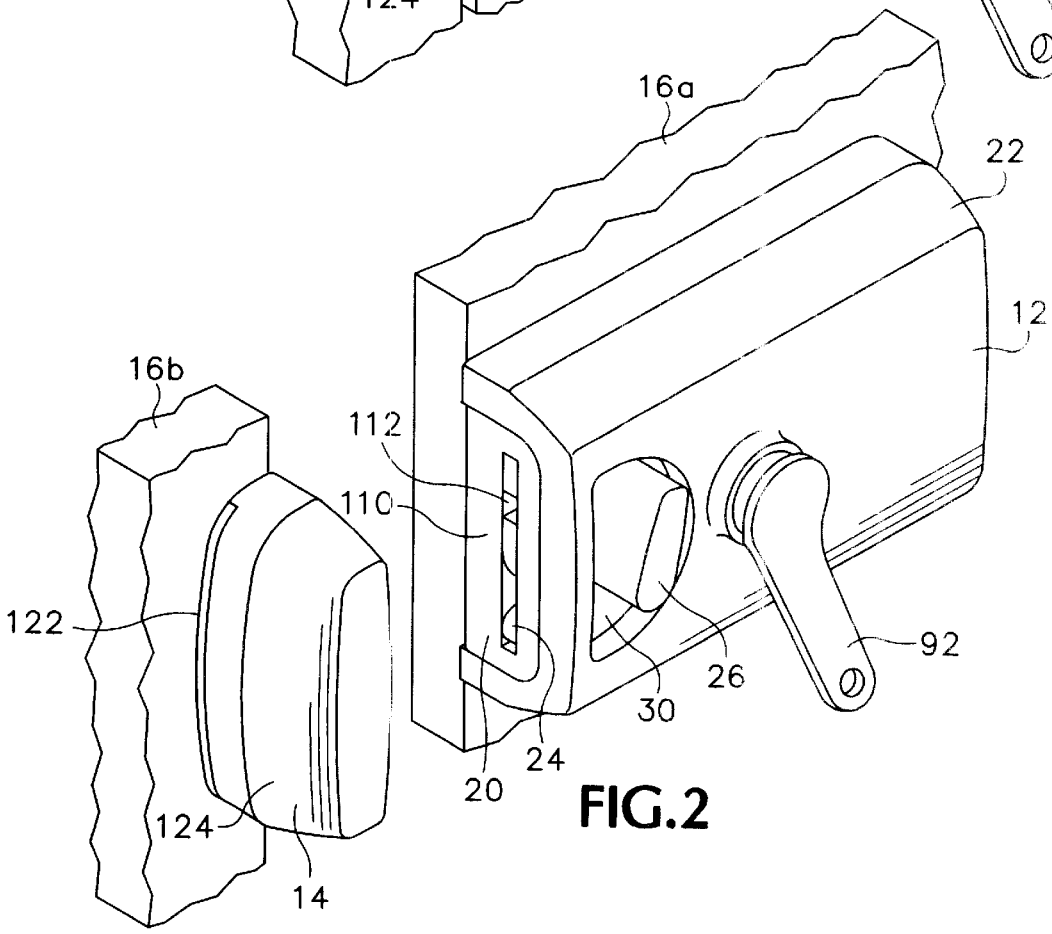
FIG. 2 shows another perspective view of an electronic access control device of FIG. 1.
Figure 6:
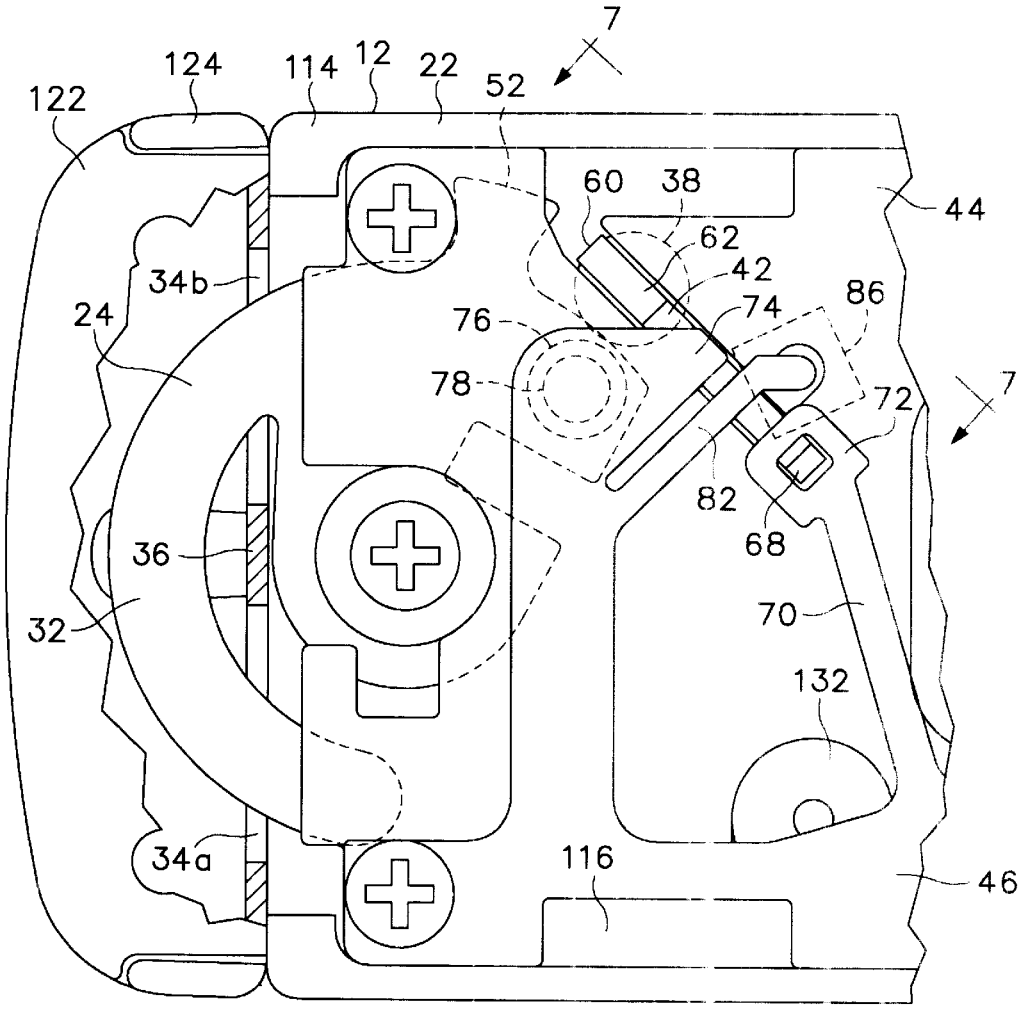
FIG. 6 shows a partial view from the bottom of the electronic access control device of FIG. 1.
Figure 10:
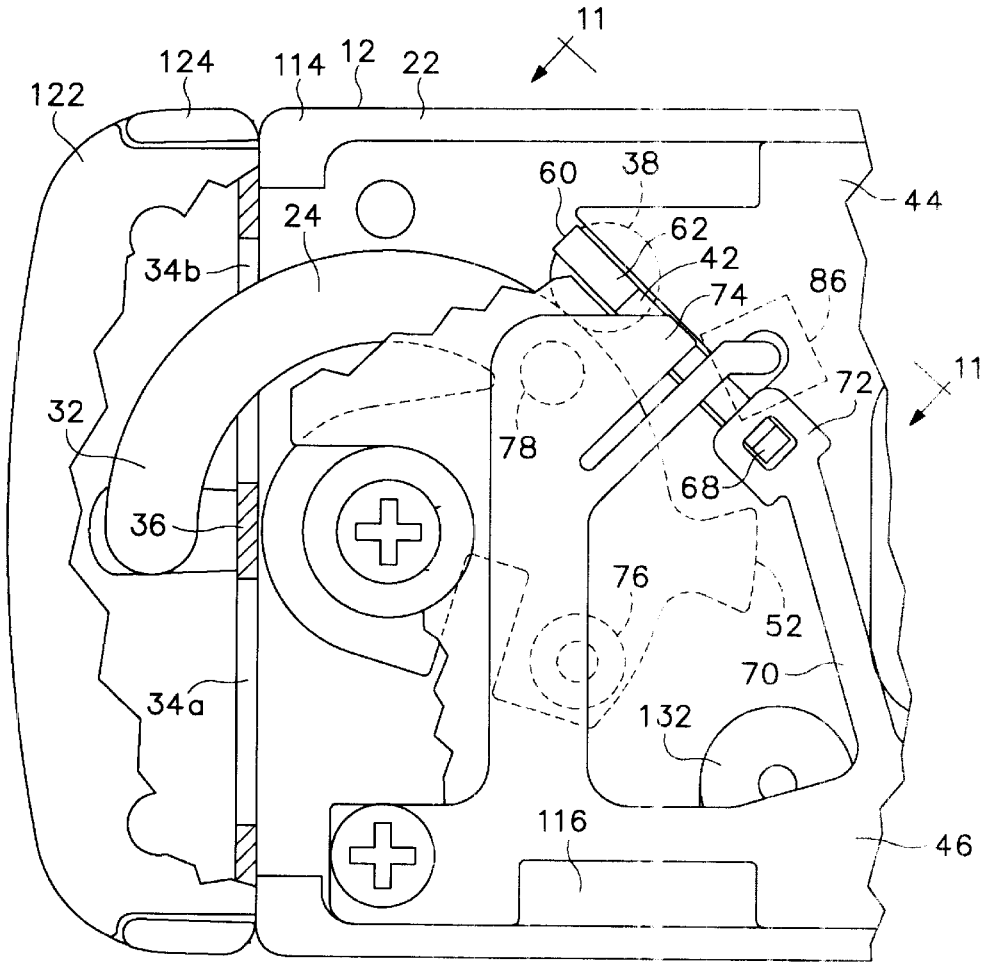
FIG. 10 shows the same view as FIG. 6 except the locking mechanism is partially opened.

The locking member 24 has an arcuate catch portion 32 which is used to secure the lock unit 12 with respect to the strike unit 14. When the locking member 24 is in the locked position, the arcuate catch portion 32 passes through the strike unit 14, so that the arcuate catch portion 32 passes through two slots 34*a, b* in the strike unit 14 and around a central member 36 of the strike unit 14. Thus, in the locked position, the locking member 24 secures the lock unit 12 to the strike unit 14. Alternatively, the locking member 24 could be a straight rod or bolt, or may be of any other elongate shape so as to extend between the lock unit 12 and strike unit 14 when in the locked position. FIG. 6 shows the lock unit 12 and strike unit 14 secured together and the catch portion 32 passing through the two slots 34*a* and 34*b* and around the central member 36 of the strike unit 14. FIG. 10 shows the locking member 24 rotated partially toward the open position. FIG. 2 shows the locking member 24 fully rotated toward the open position so that the locking member 24 is fully retracted within the housing 22.

Figure 7:
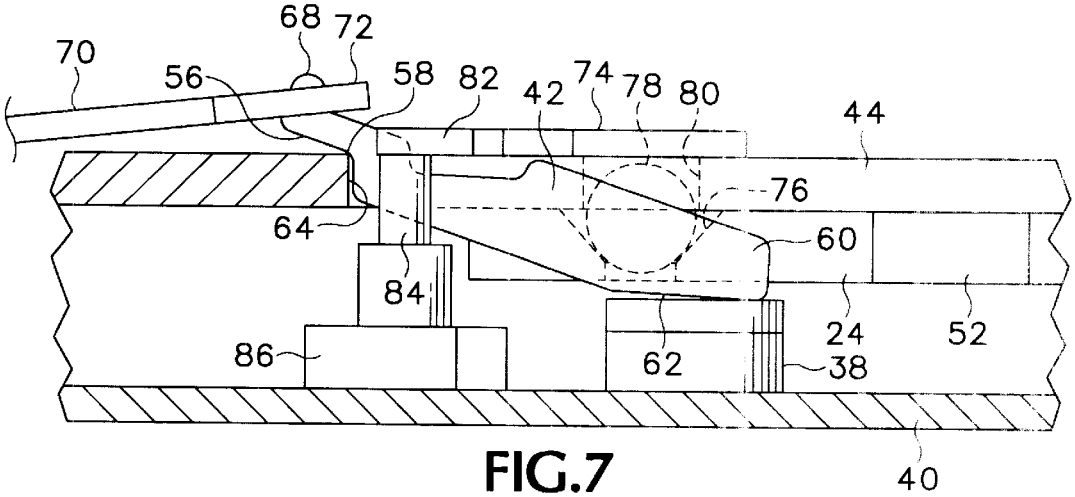
FIG. 7 shows a view taken along the line 7—7 of FIG. 6.
Figure 11:
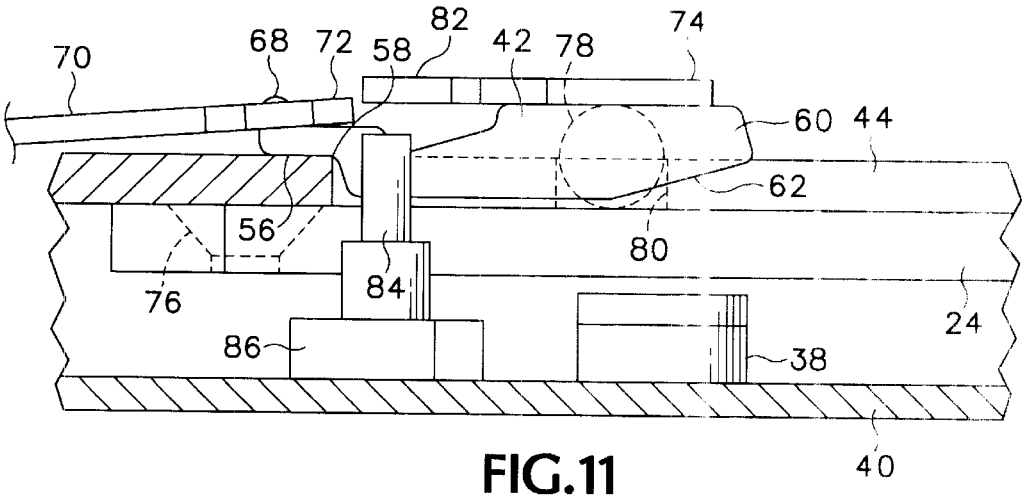
FIG. 11 shows a view taken along the line 11—11 of FIG. 10.
Figure 17:
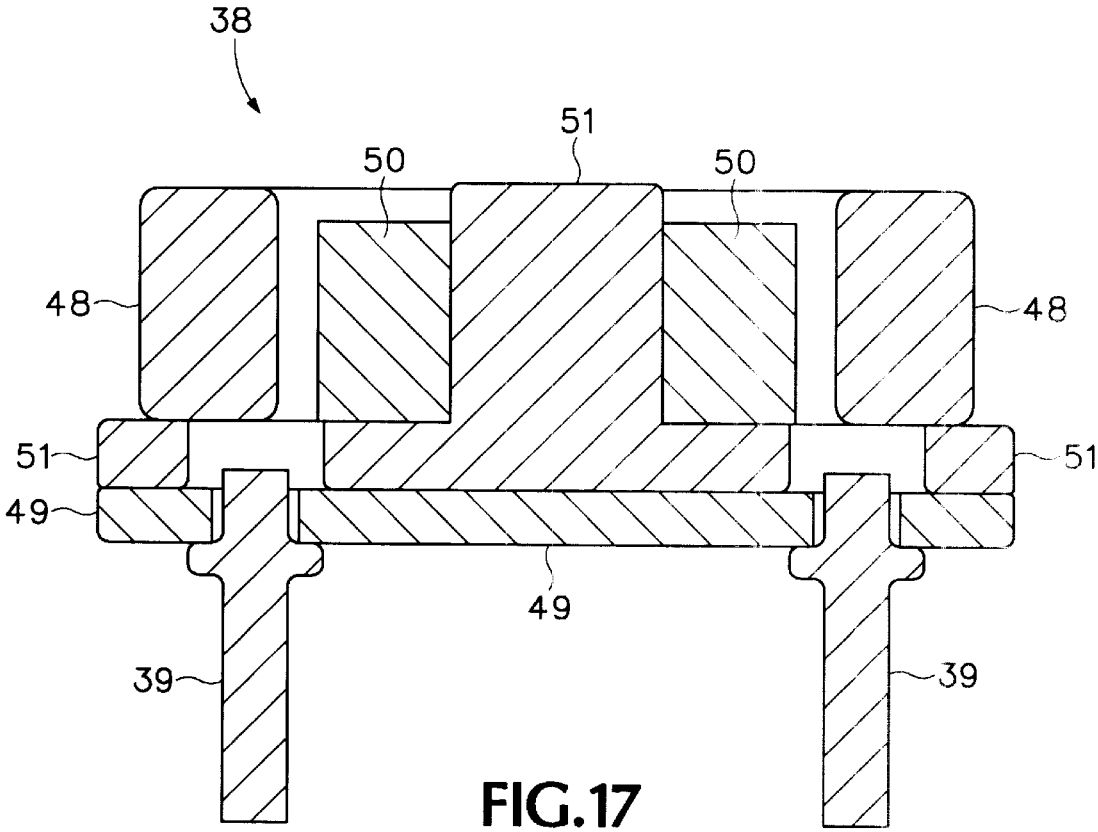
FIG. 17 shows a cross section view of an exemplary solenoid.

Returning to FIGS. 3A and 3B, a locking mechanism controls movement of the locking member 24 from the locked position to the open position. Preferably, the locking mechanism is comprised of a solenoid 38 which is mounted on a printed circuit board 40, a latch member 42 mounted on a support plate 44, and a spring plate 46. The solenoid 38 is comprised of a permanent magnet 48 surrounding a coil 50 of wire, as shown in FIG. 17. FIG. 17 shows a cross section of the solenoid having a permanent magnet 48, coil 50, pole piece 51 for focusing the magnetic field, insulating plate 49 and solenoid contacts 39. The permanent magnet 48 is cylindrical with its two poles located at the top and bottom of the solenoid 38. The coil 50 is wound around a pole piece 51 so that an electric current passing through the coil 50 induces a magnetic field which is either aligned in the same direction as the magnetic field of the permanent magnet 48 or aligned in the opposite direction of the magnetic field of the permanent magnet, depending on the direction of the current flow. The circuit board 40 is mounted to the housing, and the solenoid 38 is attached to the circuit board 40 so that a projecting member 52 of the locking member 24 passes under the solenoid 38 when the projecting member 52 is rotated past the position of the solenoid 38. FIG. 7 shows the locking member 24 in the locked position, while FIG. 11 shows the locking member rotated partially toward the open position, the projecting member 52 of the locking member 24 having rotated past the position of the solenoid 38.

Referring again to FIGS. 3A and 3B, the support plate 44 is generally flat and is connected to the housing 22 with several screws. The support plate 44 is mounted beneath the printed circuit board 40 and holds the printed circuit board 40 in place. The support plate 44 supports the latch member 42 and the spring plate 46. The support plate 44 defines an elongate groove 54 which contains the latch member 42. One end of the elongate groove 54 is located directly below the solenoid 38. The latch member 42 fits in the groove 54 and has a pivot surface 56 which rests on the support plate 44. Referring also to FIGS. 7 and 11, the edge 58 of the support plate at the end of the groove 54 acts as a fulcrum to allow the latch member 42 to pivot within the groove 54.

Figure 9:
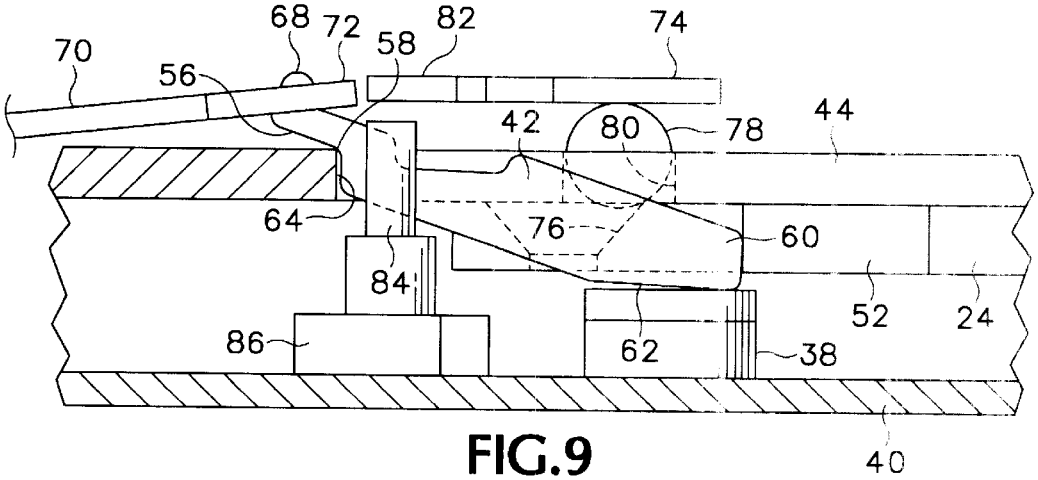
FIG. 9 shows a view taken along the line 9—9 of FIG. 8.

The front portion 60 of the latch member 42 extends beneath the solenoid 38. In the locked position, the front portion 60 of the latch member 42 is adjacent to the solenoid 38 and preferably directly contacts the permanent magnet 48. The latch member 42 is shaped so that the top 62 of the front portion 60 is flat and makes good contact with solenoid 38. When the latch member 42 is placed in contact with the solenoid 38 as shown in FIG. 7, the latch member 42 is in the locked position, so that the front portion 60 of the latch member 42 is in the same horizontal plane as the projecting member 52 of the locking member 24 to prevent rotation of the locking member 24 from the locked to the open position. The front end of the latch member 42 is squared, so that the latch member 42 in the locked position presents a flat, perpendicular surface to the projecting member 52 of the locking member 24. Similarly, the rear end 64 of the groove 54 and the rear end 66 of the latch member 42 are also squared, with surfaces perpendicular to the top surface of the support plate 44 when the latch member 42 is in the locked position, so that when the locking member 24 is rotated so as to press the projecting member 52 against the front portion 60 of the latch member 42, the force imparted by the locking member 42 is directly transferred to the support plate 44. Because the intervening surfaces are perpendicular to the support plate 44, the latch member 42 will not slip out of position when the locking member 24 is pushed against the latch member 42. This is illustrated more particularly by FIG. 9, which shows the locking member 24 rotated toward the open position and the projecting member 52 pressing against the front portion 60 of the latch member 42. The latch member 42 in FIG. 9 is in the locked position, thus preventing further rotation of the locking member 24 to the open position.

The latch member 42 has a ridge 68 along the bottom of the rear portion of the latch member 42. The spring plate 46 has a release spring 70 which preferably ends in a loop 72 which fits around the ridge 68 of the latch member 42. The pivot surface 56 of the rear portion of the latch member 42 is angled, so that in the locked position the pivot surface 56 angles away from the support plate 44, as shown in FIG. 7. When the magnetic field of the solenoid 38 is sufficiently reduced, the release spring 70 causes the latch member 42 to pivot about the edge 58, thus lowering the front portion 60 of the latch member 42 out of the plane of the projecting member 52 of the locking member 24. FIG. 11 shows the latch member 42 pivoted to the open position. This allows the locking member 24 to be rotated to the open position. The release spring 70 presses the rear portion of the latch member 42 toward the support plate 44, so that when the latch member 42 is in the open position, the pivot surface 56 of the latch member 42 is pressed flush with the bottom of the support plate 44, as shown in FIG. 11.

Alternatively, the locking mechanism may be comprised of other elements and in other alternative arrangements. For example, the locking member may be a straight rod or bolt as discussed previously. The latch member may, instead of pivoting, move in a straight line direction into and out of an interfering position with the locking member. The latch member may be placed above or below the locking member, and need only interfere with a portion of the locking member so as to resist movement of the locking member from the locked to the open position. Similarly, alternative mechanisms could be used to urge the latch member from the closed to the open position instead of a release spring. For example, coiled springs, elastomers, solenoids, or other mechanisms could be used to urge the latch member toward the open position. Thus, many different types of locking mechanisms which utilize a solenoid may be employed to achieve the function of interfering with the movement of the locking member from the locked to the open position.

Referring again to FIGS. 3A, 3B and 7, the spring plate 46 also has an anti-release spring 74 which presses against the front portion 60 of the latch member 42. The anti-release spring 74 resists movement of the front portion 60 of the latch member 42 away from the solenoid 38. The anti-release spring 74 thus acts to retain the latch member 42 in the locked position. The purpose of the anti-release spring is to prevent the latch member 42 from being jarred away from the solenoid 38 and into the open position. In the event of a sharp blow to the housing 22, the front portion 60 of the latch member 42 may be jarred in a direction away from the solenoid 38. In the absence of the anti-release spring 74, the latch member 42 may be jarred into the open position, and the locking member 24 would be free to rotate to the open position. Because the anti-release spring 74 presses against the latch member 42 if the latch member 42 is jarred away from the solenoid 38, the anti-release spring 74 prevents the latch member 42 from being jarred open in response to a sharp blow. Alternatively, other anti-release mechanisms may be used to urge the latch member 42 toward the closed position. For example, other materials could be used instead of the anti-release spring 74, such as elastomers or coiled springs. Alternatively, a mechanical member may be placed beneath the latch member, preventing the latch member from pivoting until the mechanical member has been moved out of position. The spring plate 46 also could be made of several pieces instead of a unitary piece.

The locking unit 12 also has a mechanism for pushing the anti-release spring 74 away from the latch member 42. The locking member 24 has a beveled dimple 76 in which is seated a ball bearing 78. The support plate 44 has a hole 80 with a diameter slightly larger than the diameter of the ball bearing 78. A front portion of the anti-release spring 74 is located underneath the hole 80. The dimple 76 is located in a position on the locking member 24 so that when the locking member 24 is in the locked position, the ball bearing 78 is seated in the dimple 76, as shown in FIG. 7. In the locked position shown in FIG. 7, the ball bearing 78 rests in the hole 80 in the support plate 44 and is retained by the anti-release spring 74, which prevents the ball bearing 78 from slipping out of the hole 80 in the support plate 44. When the locking member 24 is rotated, as shown by FIG. 9, the dimple 76 moves relative to the ball bearing 78, since the ball bearing 78 is prevented from rotating with the dimple 76 by the edge of the hole 80 in the support plate 44. Accordingly, the ball bearing 78 is pushed by the beveled surface of the dimple 76 to the bottom surface of the locking member 24. The ball bearing 78 in turn pushes the anti-release spring 74 to the open position away from the latch member 42. With the anti-release spring 74 pushed away from the latch member 42, the latch member 42 is free to pivot to the open position. FIG. 11 illustrates the ball bearing 78 resting on the bottom of the locking member 24 after the locking member has been rotated toward the open position. Alternatively, the mechanism for pushing the anti-release spring away from the latch member may be accomplished using other methods, such as other mechanical systems to push the anti-release spring away from the latch member 42 in response to movement of the locking member 24.

The lock unit 12 also has a mechanism for detecting movement of the locking member 24. The spring plate 46 includes a switch spring 82 which presses against the switch button 84 of a switch 86 mounted on the printed circuit board 40. In the locked position shown in FIG. 7, the switch button 84 is depressed by the switch spring 82. When the switch spring 82 is pushed away from the switch button 84 as shown in FIG. 9, the switch 86 is opened, causing a signal to be sent to a microprocessor 88. The switch spring 82 is connected to the front portion of the anti-release spring 74, so that the switch spring 82 is pushed away from the switch button 84 by the ball bearing 78 in the same manner as the anti-release spring 74 is pushed by the ball bearing 78, as shown by FIGS. 9 and 11. Thus, the ball bearing 78, switch spring 82 and switch 86 act collectively as a movement detector to detect movement of the locking member 24 from the closed position toward the open position. Other systems may be used to detect movement of the locking member 24. The switch 86, for example, could be connected directly to the locking member 24. Instead of using a switch, movement of the locking member could be used to generate an electromagnetic signal which could be detected. Movement of the locking member could also be detected optically.

The lock unit 12 also includes a key detector 90. The key detector 90 may be any device which can read a key 92 and send a signal corresponding to the key 92 to the microprocessor 88 to enable the lock to determine whether an authorized key has been presented. The key detector may accept electronic, magnetic or mechanical keys. The key detector could also comprise a data port for receiving a digital code, or comprise a keypad or mechanical entry system such as a series of numbered buttons or mechanical dials. In any of these systems, the key detector detects a key, code, password, or other representation of a key or key code and transmits a signal to the microprocessor corresponding to the key or key code.

In a preferred embodiment, the key detector 90 uses a touch button system sold under the trade name Touch Memory Button by Dallas Semiconductor of Dallas, Tex. The system operates by providing a key 92 which contains an integrated circuit housed within a stainless steel container. The system is passive, in that the key 92 has no power source. The key detector 90, in response to being touched by a key 92 (as illustrated in FIG. 2), sends a signal to the key 92 to read the key code of the key 92 encoded in the integrated circuit in the key 92. Every key 92 is unique and provides a unique key code. After reading the key code of the key 92, the key detector 90 sends a signal to the microprocessor corresponding to the key code of the key 92. Because the touch button key detector 90 uses a flat surface 94 to detect key codes and does not present an opening to the interior of the lock unit 12, the use of the touch button key detector 90 and keys 92 greatly reduce the susceptibility of the lock to being picked.

The lock unit 12 also contains a power supply 96 preferably in the form of a battery. Preferably, a 9-volt lithium or alkaline battery is used, but other types of batteries having other voltages may be used. A voltage regulator 97 regulates power from the power supply 96 to the microprocessor 88. Alternatively, a permanent power supply may be provided by connecting the electronic lock to a power line, such as a standard 120 volt power line. The power supply 96 supplies power to the solenoid 38 and the other electronics in the electronic lock. The power supply 96 is connected to the microprocessor 88, which controls the direction of current flowing from the power supply 96 to the coil 50 in the solenoid 38. Preferably, to conserve power, the power supply 96 does not supply power to the solenoid 38 when the locking member 24 is in the locked position. However, if a permanent source of power is available, the solenoid 38 could be connected to a power supply 96 so that current is constantly flowing through the coil 50 in a direction such that the induced magnetic field of the coil 50 is aligned with the permanent magnet to hold the latch member 42 in the locked position. Since in the preferred mode of operation the power supply 96 only directs power to the coil 50 in response to a signal from the microprocessor 88, the amount of power used by the electronic lock is very small.

Figure 14:
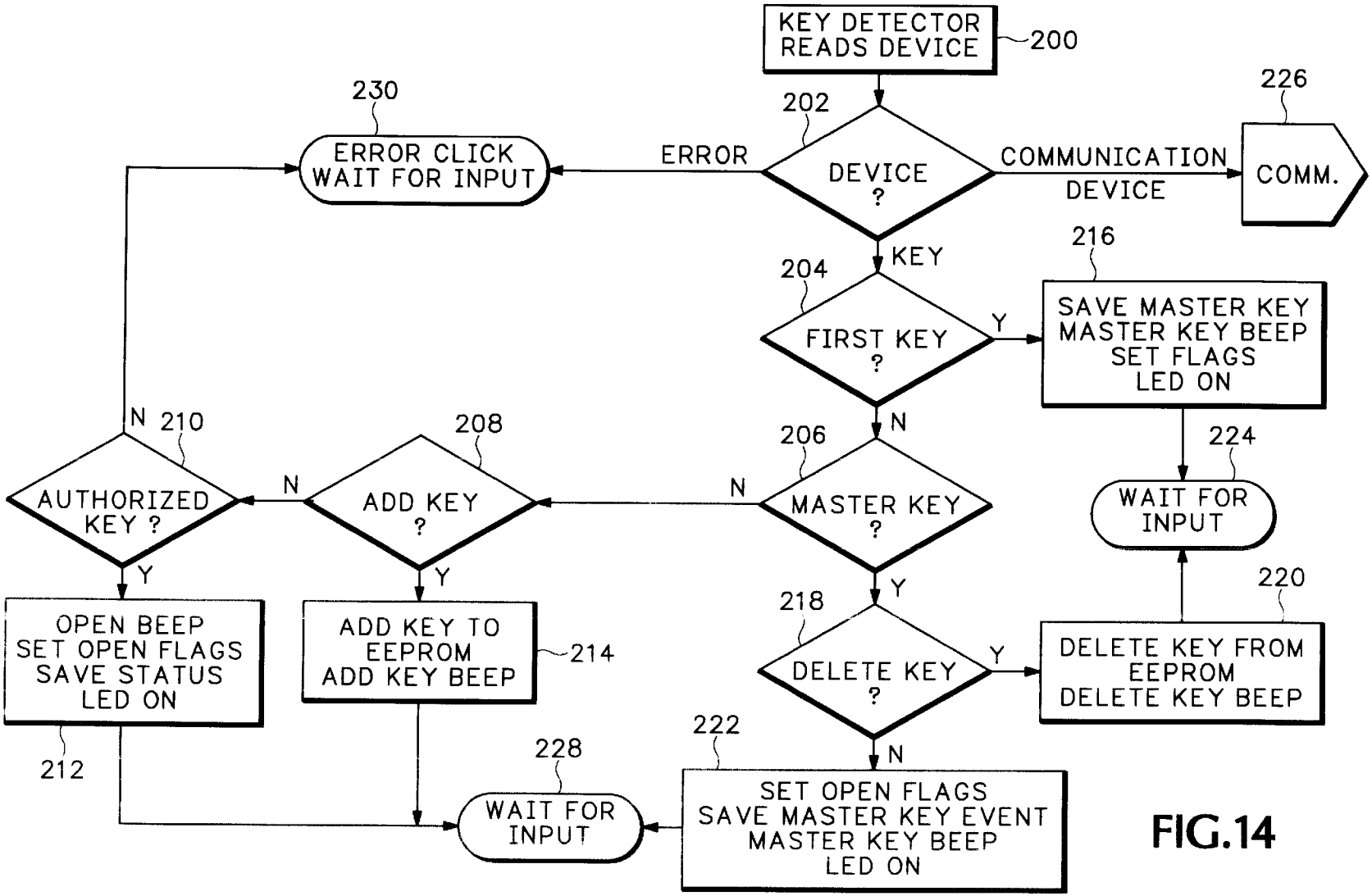
FIG. 14 shows a flow chart for an exemplary key management and detection system of the present invention.

The electronic lock may operate as follows. When the locking member 24 is in the locked position shown in FIGS. 6 and 7, the latch member 42 is held in the locked position by the anti-release spring 74 and the permanent magnet of the solenoid 38. Preferably, no power is flowing through the coil 50 of the solenoid 38. Referring to FIG. 2, a key 92 is presented to the key detector 90. The microprocessor 88 keeps stored in memory 98 the key codes which are authorized to open the lock. Referring now to FIG. 14, the key detector 90 in box 200 generates a signal corresponding to the key code from the key detector 90 to the microprocessor 88. In box 202, the microprocessor 88 determines whether the device presented to the key detector 90 is a key 92. Assuming a master key has not been presented, the microprocessor 88 proceeds through the steps shown in boxes 204, 206, and 208 until it reaches box 210. In box 210, the microprocessor 88 determines whether the key code received from the key detector 90 matches an authorized key code stored in the memory 98. If an authorized key code is received, the microprocessor 88 in box 212 sets a status open flag indicating the lock may be opened. If a master key is presented, the microprocessor proceeds to box 222 and again sets a status open flag to indicate the lock may be opened.

Figure 15:
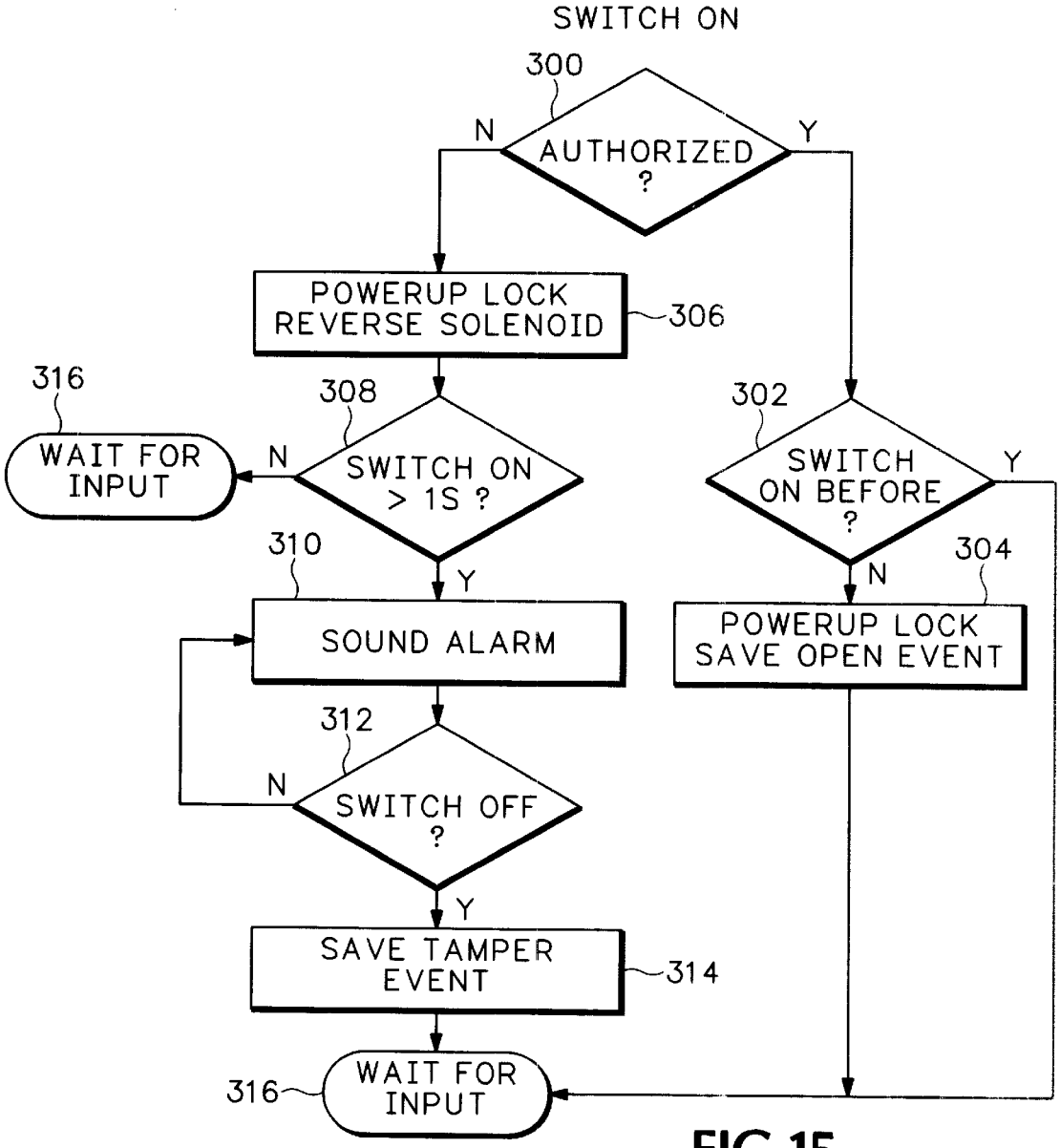
FIG. 15 shows a flow chart for an exemplary method of controlling current through a solenoid of an exemplary electronic access control device of the present invention.

The knob 26 may then be turned, which causes the anti-release spring 74 to be pushed away from the latch member 42 and also causes the switch 86 to send a signal to the microprocessor 88 indicating the locking member 24 has been moved. Referring now to FIG. 15, when the microprocessor 88 receives a signal from the switch 86, the microprocessor 88 in box 300 checks the status open flag to determine whether the lock may be opened. If the status open flag indicates the lock may be opened, the microprocessor 88 in box 302 checks to see if the switch has already been on, and if not, in box 304 directs current from the power supply 96 to the coil 50 in a direction that causes the magnetic field induced in the coil 50 to be aligned opposite to the magnetic field of the permanent magnet. The induced magnetic, field of the coil 50 is sufficiently strong so that the release spring 70 pivots the latch member 42 from the locked position to the open position. As shown in FIGS. 10 and 11, the locking member 24 may then be rotated by the knob 26 toward the open position. Alternatively, the microprocessor could direct power to the coil 50 immediately in response to receiving an authorized key code from the key detector 90 instead of waiting for a signal from the switch 86.

Figure 8:
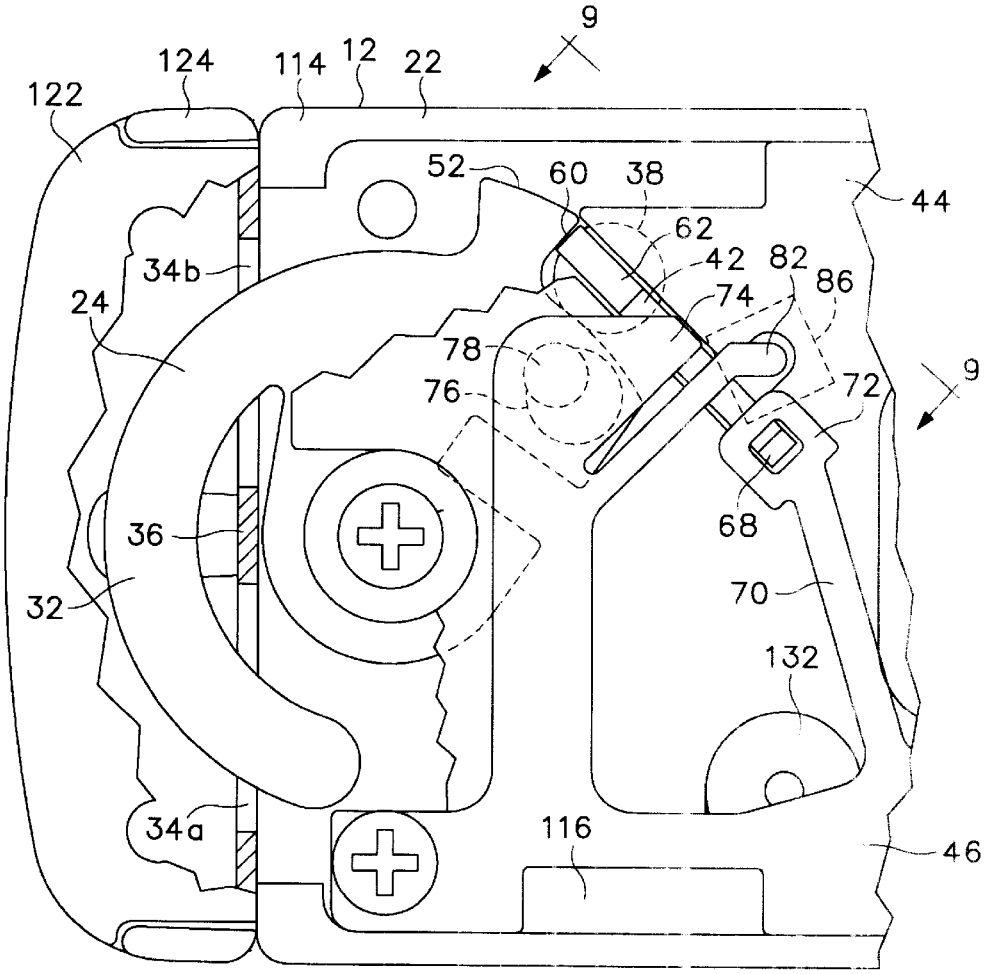
FIG. 8 shows the same view as FIG. 6 except the locking member has been rotated toward the open position.

As can be seen in FIG. 9, when the anti-release spring 74 is pushed away from the latch member 42, the latch member 42 is susceptible to being jarred open by a sharp blow to the housing 22. To prevent this, if the switch 86 is open (as in FIGS. 8 and 9) and no signal for an authorized key has been received, the microprocessor 88 directs an electric current from the power supply 96 to the coil 50 of the solenoid 38. This is shown by boxes 300 and 306 of FIG. 15. The current flows through the coil 50 in the opposite direction of the current flow used to open the lock. Thus, the microprocessor 88 directs the current through the coil 50 so that the induced magnetic field in the coil 50 is aligned in the same direction as the magnetic field of the permanent magnet. Thus, the resulting force imparted by the solenoid 38 on the latch member 42 can be greatly increased. By increasing the amount of magnetic force applied to the latch member 42 in response to an unauthorized attempt to open the lock, the current flow through the solenoid 38 reduces the susceptibility of the latch member 42 from being jarred out of place in response to a sharp blow to the housing 22.

In addition, reversing the current flow in the solenoid 38 in response to an unauthorized attempt to open the lock allows a smaller permanent magnet with a reduced magnetic field to be used with the lock, because the reversed current flow aids the permanent magnet in holding the latch member 42 in place. A smaller permanent magnet has several advantages. First, a smaller permanent magnet with a reduced magnetic field requires a smaller induced magnetic field to allow the release spring 70 to pivot the latch member 42 to the open position. This translates into less power consumption by the lock. In addition, a smaller permanent magnet reduces the size and cost of the electronic lock.

Figure 18:
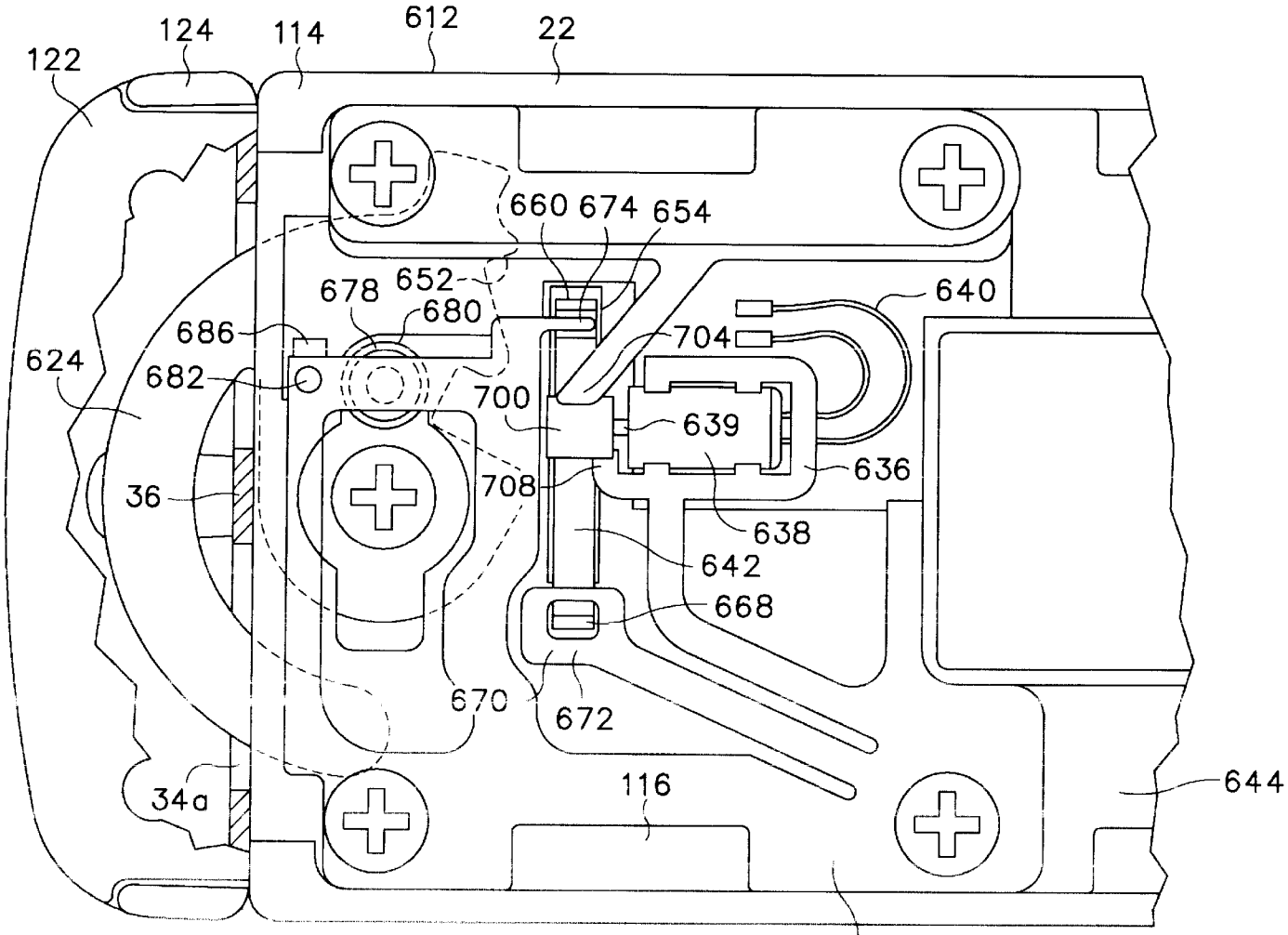
FIG. 18 shows a partial view from the bottom of an alternative electronic access control device.
Figure 19:
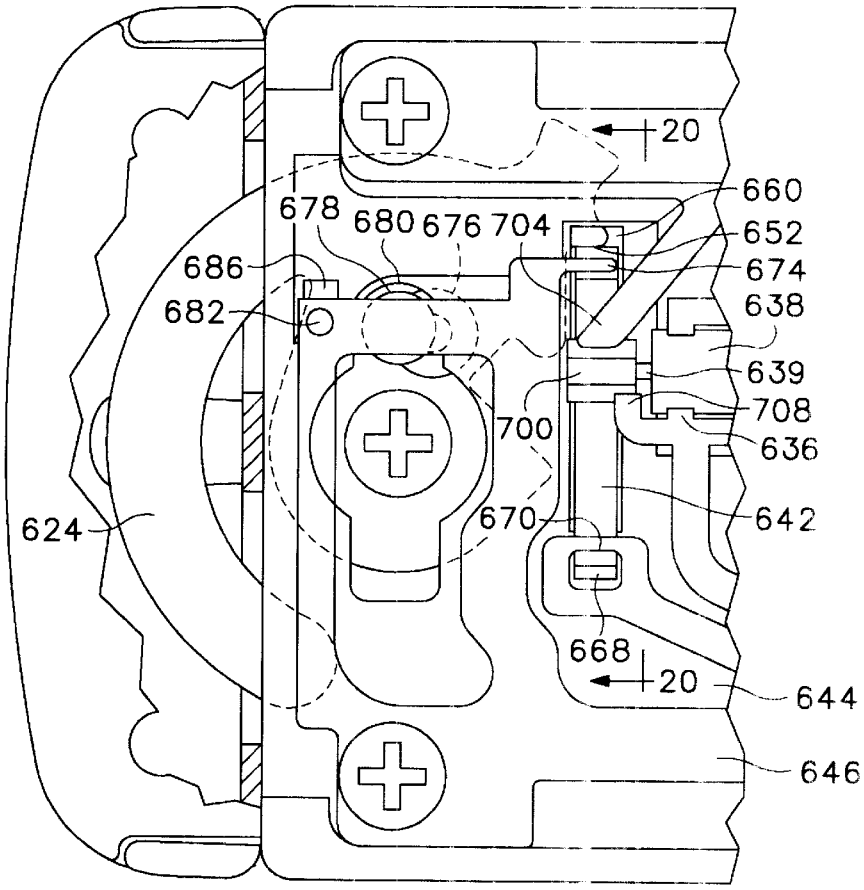
FIG. 19 is a view similar to a portion of FIG. 18, but with the locking member partially rotated toward the open position.
Figure 20:
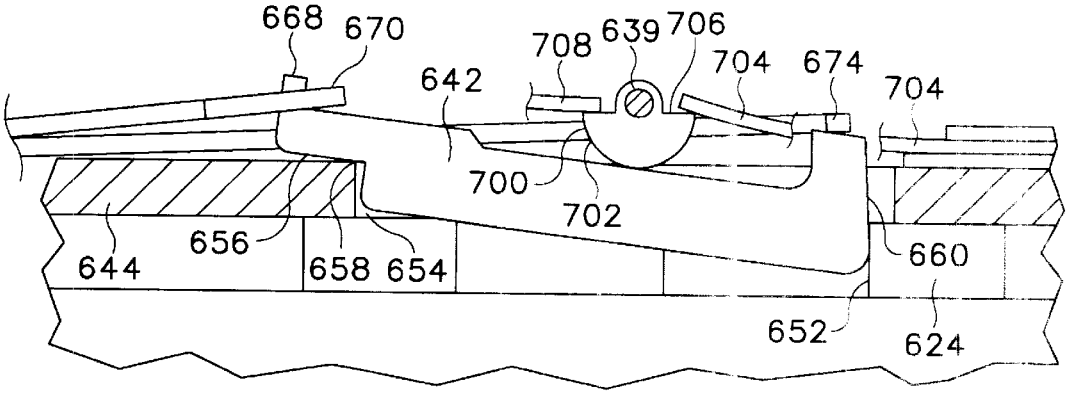
FIG. 20 is a partial cross section taken along the line 20—20 of FIG. 19.
Figure 21:
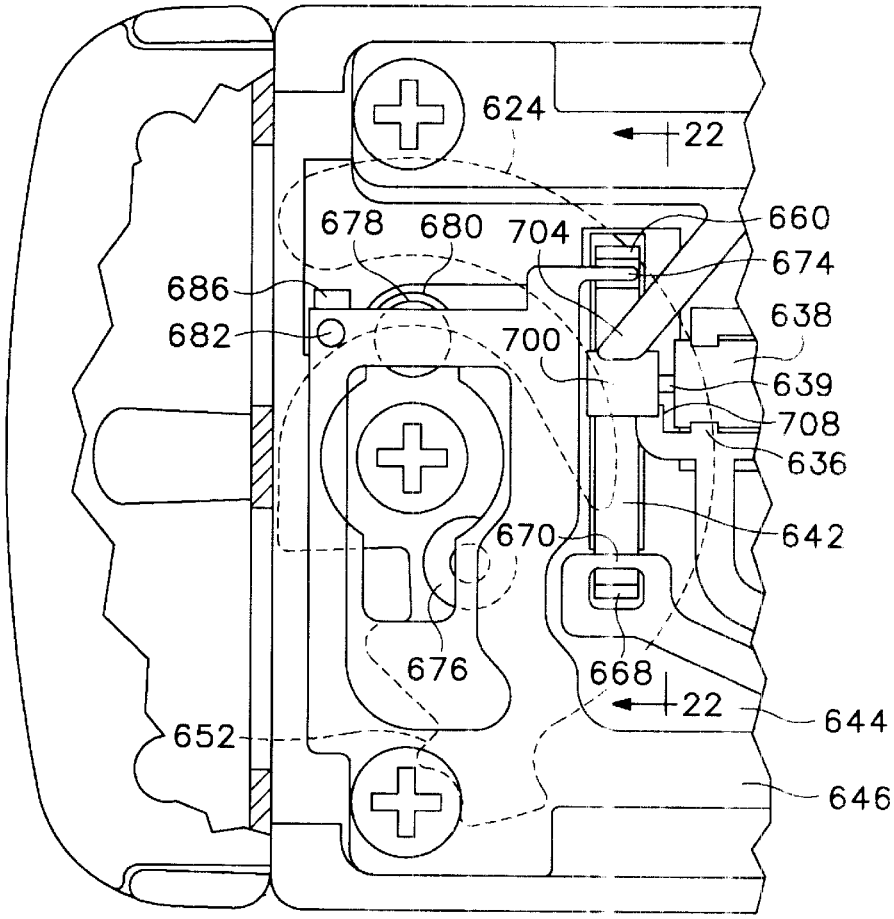
FIG. 21 is the same view as in FIGS. 18 and 19, but the locking member rotated to the open position.

FIGS. 18–22 show an alternative preferred embodiment of a lock unit 612 of the present invention having an alternative locking mechanism. Like numerals correspond to like elements illustrated in the embodiment shown in FIGS. 1–12. In this embodiment, solenoid 38 of the embodiment of FIGS. 1–12 is replaced with an electric motor 638. As in the embodiment in FIGS. 1–12, a knob is connected to a shaft which passes through the housing and is connected to the locking member 624. Rotation of the knob 26 causes the locking member 624 to rotate from the open to the locked position. A locking mechanism controls movement of the locking member 624 from the locked position to the open position. The locking mechanism is comprised of an electric motor 638 which is mounted on the support plate 644, a latch member 642 mounted on the support plate 644, and a spring plate 646. The electric motor 638 has attached to it a shaft 639 and a rotating member 700. Power is supplied to the electric motor 638 from a battery by electrical connections 640. The electric motor 638 may be an electric motor from a vibrating pager. A bracket 636 holds the motor 638 in place. FIG. 18 shows the locking member 624 in the locked position while FIG. 19 shows the locking member rotated partially toward the open position. FIG. 21 shows the lock member 624 rotated completely to the open position.

Referring now to FIGS. 18, 19 and 21, the support plate 644 defines an elongate groove 654 which contains the latch member 642. The elongate groove 654 is located adjacent to the electric motor 638. The latch member 642 fits in the groove 654 and has a pivot surface 656 which rests on the support plate 644. The edge 658 of the support plate at the end of the groove 654 acts as a fulcrum to allow the latch member 642 to pivot within the groove 654. As shown in FIG. 20, when the latch member 642 is in the locked position, the front portion 660 of the latch member 642 confronts the blocking surface 652 of the locking member 624 to prevent rotation of the locking member 624 from the locked to the open position. The latch member 642 has a ridge 668 along the bottom of the rear portion of the latch member 642. The spring plate 646 has a release spring 670 which preferably ends in a loop 672 which fits around the ridge 668 of the latch member 642. The pivot surface 656 of the latch member 642 is angled so that in the locked position the pivot surface 656 angles away from the support plate 644, as shown in FIG. 20.

The electric motor 638 prevents movement of the latch member 642 as follows. The rotating member 700 is in the shape of a partial cylinder. In the locked position the curved portion 702 of the rotating member 700 faces and/or contacts the bottom of the latch member 642, thus interfering with the pivoting movement of the latch member 642 from the closed to the open position. A resilient spring arm 704 presses against a lower flat surface 706 of the rotating member 700 so as to resist rotation of the rotating member 700 in the counter-clockwise direction (as viewed in FIG. 20) while a stop 708 prevents rotation of the rotating member in the clockwise direction. The spring arm 704 may be made from plastic or any other suitable sturdy, flexible material. Collectively the spring arm 704 and stop 708 bracket the rotating member 700 to prevent the rotating member 700 from being jarred by a sharp blow to the lock unit into a non-interfering position.

Figure 22:
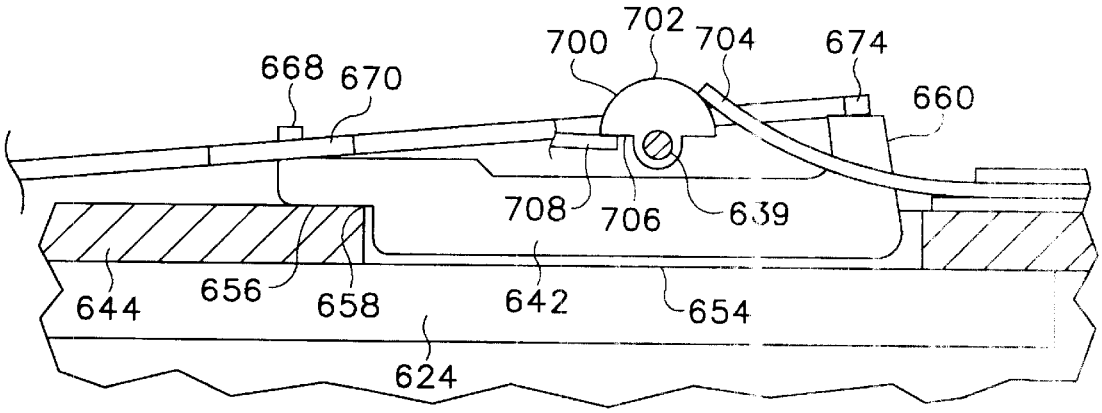
FIG. 22 is cross section taken along the line 22—22 of FIG. 21.

When the lock microprocessor 88 receives a signal indicating authorized access power is provided from the battery to the motor 638 so as to rotate the rotating member 700 in a counter-clockwise direction so that the curved portion 702 is moved to a non-interfering position with respect to the latch member 642, as shown in FIG. 22. The stop 708 prevents further rotation of the rotating member 700. Only a short burst of power is supplied to the motor 638 so that the rotating member 700 is rotated out of interference, but power is not continuously supplied so as to avoid running down the battery. The spring arm 704 is sufficiently flexible so that the spring arm 704 allows the rotating member 700 to rotate counter-clockwise, such that the spring arm 704 is located beneath the curved portion 702 of the rotating member as shown in FIG. 22. When the rotating member 700 is rotated counter-clockwise to a non-interfering position, the release spring 670 causes the latch member 642 to pivot about the edge 658, thus lowering the front portion 660 of the latch member 642 out of the plane of the blocking surface 652 of the locking member 624. FIG. 22 shows the latch member 642 pivoted to the open position. This allows the locking member 624 to be rotated to the open position. The release spring 670 presses the rear portion of the latch member 642 toward the support plate 644 so that when the latch member 642 is in the open position the pivot surface 656 of the latch member 642 is pressed flush with the bottom of the support plate 644, as shown in FIG. 22.

When the lock member 624 is rotated back to the locked position, the motor 638 is energized so as to rotate the rotating member 700 back to an interfering position as shown in FIG. 20. The stop 708 prevents further rotation of the rotating member 700 in the counterclockwise direction, while the spring arm 704 returns to a position above the flat surface 706 of the rotating member.

The spring plate 670 also has an anti-release spring 674 which presses against the front portion 660 of the latch member 642. The anti-release spring 674 resists movement of the front portion 660 of the latch member 642 away from the locked position. The anti-release spring 674 thus acts to retain the latch member 642 in the locked position. The purpose of the anti-release spring is to prevent the latch member 642 from being jarred into the open position. In the absence of the anti-release spring 674, the latch member 642 may be jarred by a sharp blow to the lock unit into the open position, allowing the locking member 624 to be rotated to the open position. Because the anti-release spring 674 presses against the latch member 642, the anti-release spring 674 prevents the latch member 642 from being jarred open in response to a sharp blow.

The lock unit 612 also has a mechanism for pushing the anti-release spring 674 away from the latch member 642. The locking member 624 has a beveled dimple 676 in which is seated a ball bearing 678. The support plate 644 has a hole 680 with a diameter slightly larger than the diameter of the ball bearing 678. A portion of the anti-release spring 674 is located underneath the hole 680. In the locked position shown in FIG. 18, the ball bearing 678 rests in the hole 680 in the support plate 644 and is retained by the anti-release spring 674, which prevents the ball bearing 678 from slipping out of the hole 680 in the support plate 644. When the locking member 624 is rotated toward the open position, as shown by FIG. 19, the dimple 676 moves relative to the ball bearing 678, since the ball bearing 678 is prevented from rotating with the dimple 676 by the edge of the hole 680 in the support plate 644. Accordingly, the ball bearing 678 is pushed by the beveled surface of the dimple 676 to the bottom surface of the locking member 624. The ball bearing 678 in turn pushes the anti-release spring 674 to the open position away from the latch member 642. With the anti-release spring 674 pushed away from the latch member 642, the latch member 642 is free to pivot to the open position. FIG. 21 illustrates the ball bearing 678 resting on the bottom of the locking member 624 after the locking member 624 has been rotated to the open position.

The lock unit 612 also has a mechanism for detecting movement of the locking member 624. The spring plate 646 includes an electrical contact 682 which presses against another electrical contact 686 mounted beneath the support plate. In the locked position shown in FIG. 18, the contact 682 is pressed against contact 686 to form a closed circuit. When the contact 682 is pushed away from the contact 686, an open circuit is created, which is detected by the microprocessor 88. The contact 682 is mounted on the anti-release spring 674, so that the contact 682 is pushed away from the contact 686 by the ball bearing 678 in the same manner as the anti-release spring 674 is pushed by the ball bearing 678. Thus, the ball bearing 678, contact 682 and contact 686 act collectively as a movement detector to detect movement of the locking member 624 from the closed position toward the open position.

When the movement detector detects movement of the lock member 624 without an authorized key being presented to the lock, the microprocessor causes the motor 638 to be energized so as to rotate in the clockwise direction so that the rotating member is pushed against the stop 708, as viewed in FIG. 20. The motor 638 continues to apply power so long as the movement detector indicates that the lock member 624 has been moved but no authorized signal has been received by the microprocessor 88. The stop 708 prevents rotation of the rotating member 700 to a non-interfering position. By continuously supplying power to the motor 638, the rotating member 700 is firmly held in an interfering position to prevent pivotal movement of the latch member 642 from the open to the closed position. Thus, both the spring arm 704 and the motor 638 act together to urge the rotating member 700 toward an interfering position in response to an unauthorized attempt to open the lock. This prevents the lock from being opened by jarring the latch member 642 into the open position when the lock member 624 is rotated.

Assembly and Mounting

Referring now to FIGS. 1 through 5, in one preferred aspect of the invention, the electronic lock 10 is mounted to the exterior surfaces 16*a, b* of a drawer, cabinet, door, or other similar structure or device. The base member 20 preferably has a plurality of mounting members 100, each of which passes through a respective hole 102 in base member 20, to mount the lock unit 12 to the surface 16. The mounting members 100 may be screws, bolts, or any suitable mechanical fastening device. The base member 20 has several engaging members 104 projecting away from the horizontal plane 106 of the base member 20. The engaging members 104 are "L" shaped, having a portion projecting perpendicularly away from the plane 106 and another tab portion 108 directed generally parallel to the plane 106. The base member 20 also has a front portion 110 projecting away from the plane 106 at a generally perpendicular angle. The front portion 110 of the base member 20 has a slot 112 through which the catch portion 32 of the locking member 24 passes when rotated to the locked position.

The housing 22 and base member 20 fit together to form an enclosure containing the various components of the electronic lock 10. The housing 22 is sized to surround the base member 20, so that the bottom periphery 114 of the housing 22 surrounds the base member 20. Preferably, the bottom periphery 114 of the housing 22 is flush with the surface 16 on which the lock unit 12 is mounted. Because the housing 22 surrounds the base member 20 and is flush with the surface 16, the housing 22 prevents access to the mounting members 100. Thus, when the housing 22 and base member 20 are secured to each other to form an enclosure, the mounting members 100 cannot be accessed to remove the lock unit 12 by attempting to cut or drill out the mounting members 100.

Figure 4:
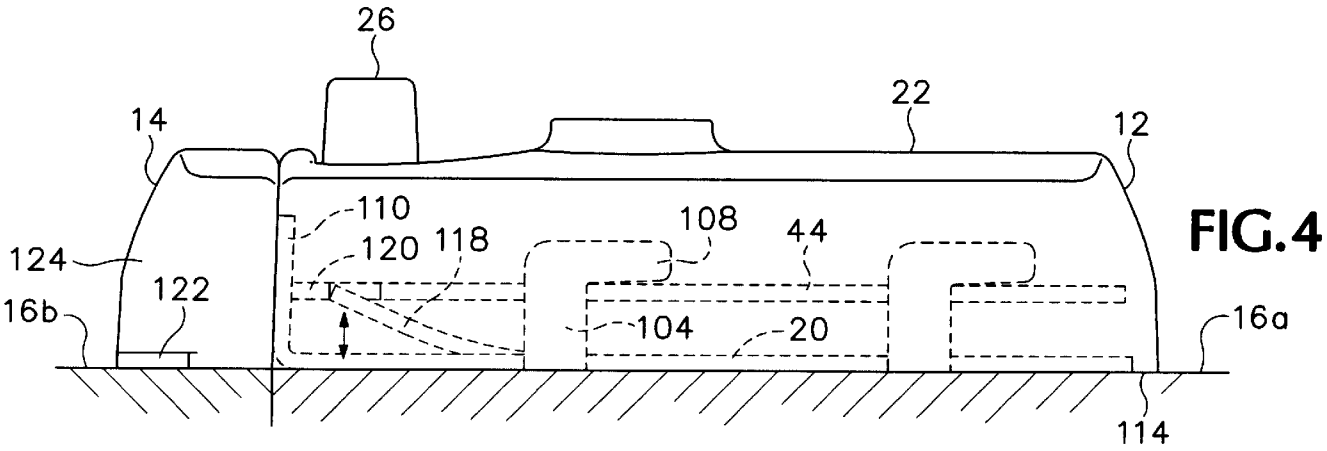
FIG. 4 shows a side partial sectional view of the electronic access device of FIG. 1.
Figure 5:
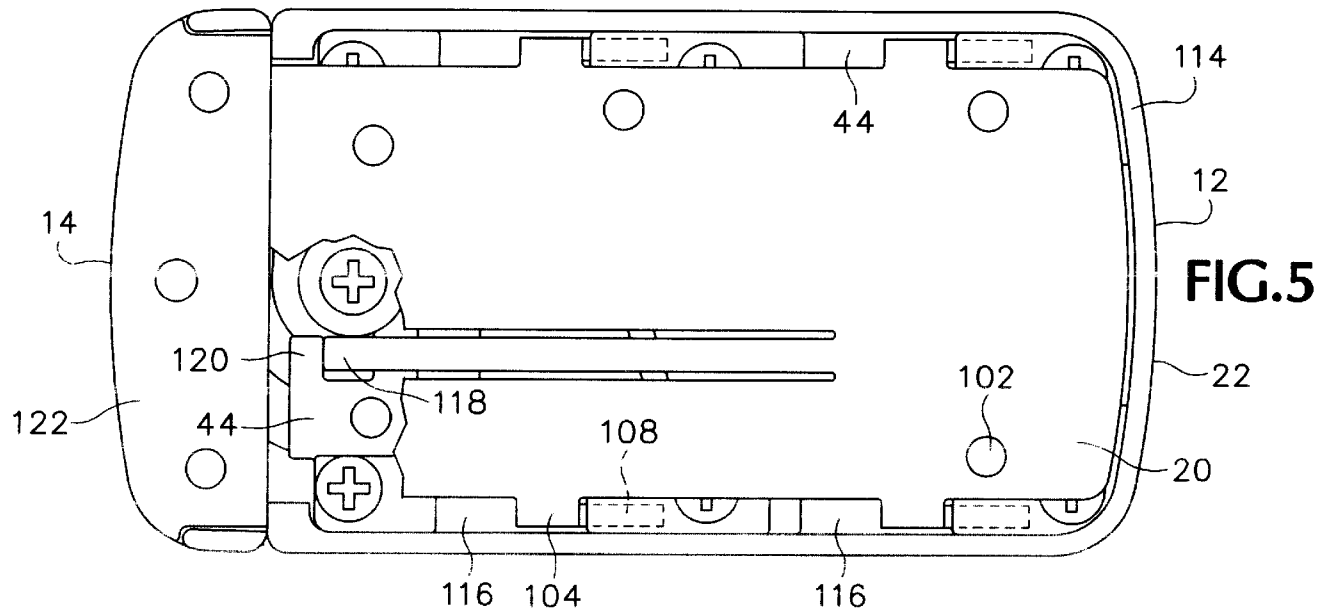
FIG. 5 shows a bottom view of the electronic access device of FIG. 1.

The housing 22 and base member 20 are secured to each other with the engaging members 104. The tab portions 108 of the engaging members 104 fit in receiving slots 116 of the support plate 44. To attach the housing 22 to the base member 20, the tab portions 108 of the engaging members 104 are first pushed through the receiving slots 116 of the support plate 44. The housing 22 is then moved laterally relative to the base member 20, so that the tab portions 108 of the engaging members 104 hook over the support plate 44. As the housing 22 is moved laterally, the front portion of the housing 22 is moved toward the front portion 110 of the base member 20 until the front portion of the base member 110 abuts the housing 22 and the support plate 44. Because the tabs 108 hook over the support plate 44, the housing 22 cannot be pulled vertically away from the base member 20 without first sliding the housing 22 laterally relative to the base member 20. FIGS. 4 and 5 illustrate the assembled housing 22 and base member 20, showing the tab portions 108 hooked over the support plate 44.

The base member 20 and housing 22 are further secured to prevent lateral movement through a catch spring 118 attached to the base member 20. The catch spring 118 protrudes inwardly from the base member 20. The support plate 44 has a lip 120 which is located at the front of the support plate 44. When the housing 22 moves laterally relative to the base member 20, the lip 120 travels toward the catch spring 118. The lip 120 depresses the catch spring 118 as the housing 22 continues to move into engagement with the base member 20. When the lip 120 passes the catch spring 118, the catch spring 118 springs back into its relaxed position. In the relaxed position, the catch spring 118 interferes with the lip 120 when the housing 22 is pushed laterally in the opposite direction to remove the housing 22 from the base member 20. Thus, the catch spring 118 and lip 120 together prevent the base member 20 and housing 22 from becoming separated. FIGS. 4 and 5 show the catch spring 118 in the relaxed position and abutting the lip 120 to prevent relative lateral movement of the housing 22 with respect to the base member 20.

When the housing 22 and base member 20 are assembled, the catch spring 118 may be depressed by inserting a tool through the slot 112 and pressing down against the catch spring 118. This can only be done when the locking member 24 is rotated to the open position, and the lock unit 12 is moved relative to the strike unit 14 so that there is enough room to insert a tool into the slot 112, as shown in FIG. 2. With the catch spring 118 depressed, the lip 120 is free to travel over and past the catch spring 118 when the housing 22 is pushed laterally with respect to the base member 20 to disengage the tab portions 108 from the support plate 44.

Alternatively, other mechanisms may be used to matingly engage the housing 22 with the base member 20. Other mechanical catches or latches may be used to secure the housing to the base member. In addition, the base member and housing may be composed of one or more units, such that the enclosure is formed by more than two elements.

The electronic lock 10 presents few openings through which the electronic lock 10 may be picked when the lock unit 12 and strike unit 14 are secured together. Like the lock unit 12, the strike unit 14 is comprised of two parts, a base member 122 and a housing 124. The base member has two slots 34*a, b* for receiving the catch portion 32 of the locking member 24, and a central member 36 between the slots 34. When the lock unit 12 and strike unit 14 are secured together, the catch portion 32 passes through the slot 112 of the housing 22 as well as the slots 34*a, b* of the strike unit 14. The locking member 24 substantially fills each of the slots. Thus, it is very difficult to pick the electronic lock 10 because the housings of the lock unit 12 and strike unit 14 do not present any openings, and the locking member 24 fills the slots in the lock unit 12 and the strike unit 14.

Key Management

Figure 13:
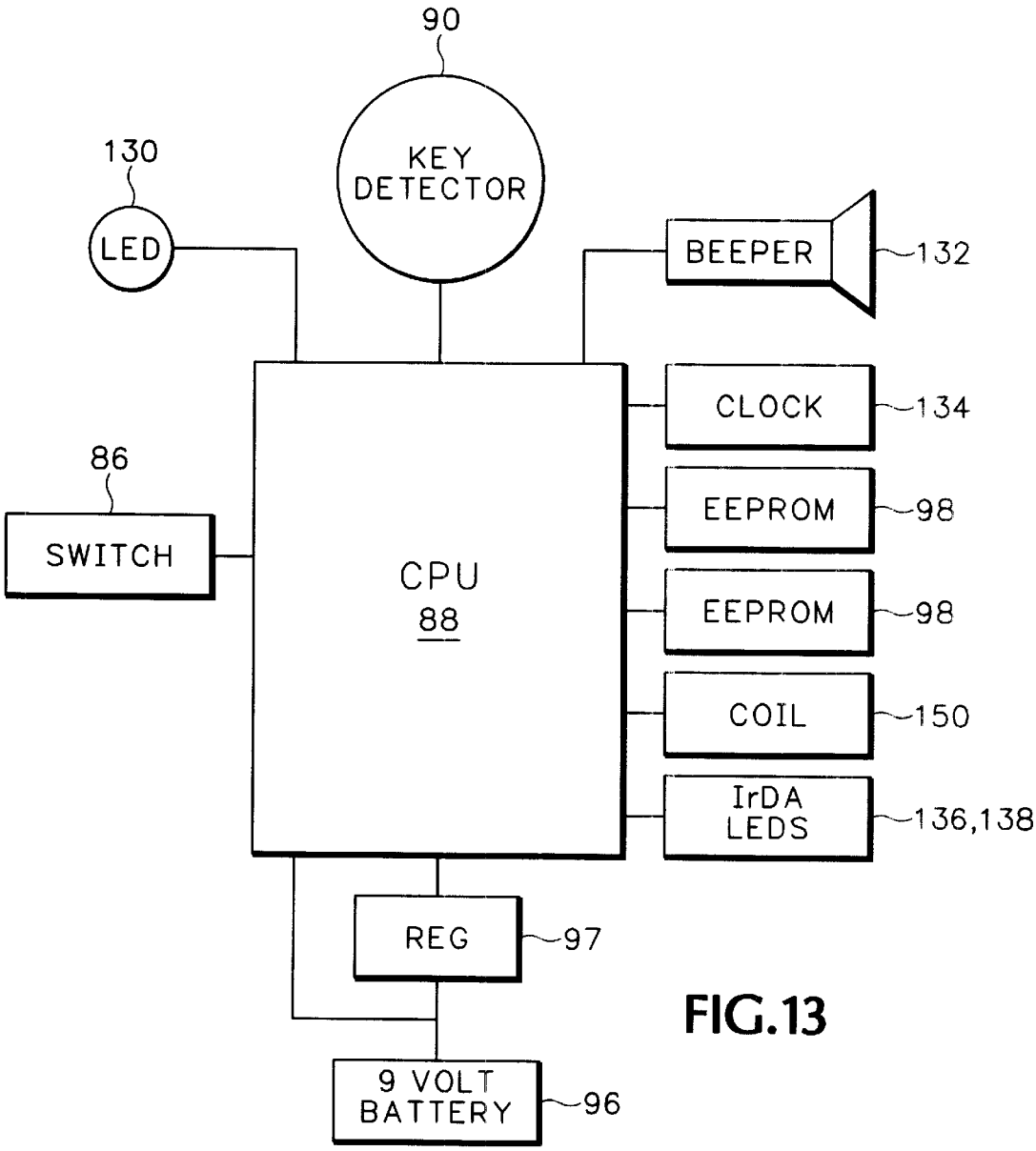
FIG. 13 shows an exemplary block diagram of a circuit for an electronic access control device of the present invention.

In another separate preferred aspect of the invention, a key management system is provided to manage which keys are authorized to open the electronic lock 10. Referring to FIG. 13, the electronic lock 10 includes a memory 98 for storing key codes corresponding to keys which are authorized to open the electronic lock 10. When a key 92 is detected by the key detector 90 (as in FIG. 2), the key detector 90 sends a signal to the microprocessor 88 in the form of a key code corresponding to the key 92. The microprocessor 88 compares the received key code with the authorized key codes stored in the memory 98, and if the key 92 is an authorized key, the lock may be opened.

The electronic lock 10 has a microprocessor 88 (shown schematically in FIG. 13) which is used to receive signals from the key detector 90. The electronic lock 10 has memory 98 in the form of Electronically Erasable Programable Read Only Memory (EEPROM) which is connected to the microprocessor 88. Collectively, the microprocessor 88 and associated memory 98 comprise a computer system. The computer system which may be used in the present invention may be any device, whether a microprocessor alone or in combination with other processors and/or memory devices, which performs the functions described herein relating to the reading, writing, deleting, storing and comparing of information relating to key codes.

In order to add and delete authorized key codes stored in memory 98, the key management system preferably utilizes a master key. In a preferred embodiment, the master key is the first key detected by the key detector 90. When power is first supplied to the microprocessor 88, the memory 98 contains no authorized key codes. Referring now to FIG. 14, when the microprocessor 88 in box 204 receives a first key code generated by the key detector 90, the microprocessor 88 in box 216 adds the key code of the first key to the authorized key codes stored in the memory 98. In addition, the microprocessor 88 in box 216 stores the first key code as the master key code in the memory.

By storing the first key code to be detected as the master key code, the key management system greatly reduces the complexity of providing a master key for the lock. Master keys do not need to be created especially for any particular lock. Because the first key touched to the electronic lock becomes the master key, it is not necessary to program each lock to store a particular key code as the master key. Thus, electronic locks may be manufactured identically and can be used with any key as the master key.

The master key may be used to add and delete key codes from the stored authorized key codes. Referring again to FIG. 14, when the microprocessor 88.in box 206 receives a signal corresponding to the key code for the master key, the event is saved in box 222. If the microprocessor 88 then receives a second signal corresponding to a second key, the microprocessor proceeds to box 208, in which the microprocessor determines whether the second key is an authorized key and whether the key code for the master key has been received within a certain amount of time (as saved in box 222). If the second key is not an authorized key, and the master key code was already received within the predetermined time, then the microprocessor 88 in box 214 adds the second key code to the authorized key codes stored in memory 98. It is therefore easy to add numerous key codes to the memory 98 of the electronic lock 10 by simply first placing the master key on the key detector 90, and then placing on the key detector 90 the keys which are desired to be added as authorized keys. The system therefore avoids the necessity of separately programming the lock to store key codes in memory which are authorized to open the lock.

In a similar fashion, a key code may be deleted from the authorized keys in the memory 98 by first placing the key to be deleted on the key detector 90 and then placing the master key on the key detector 90. In box 218, when the microprocessor 88 has received a signal corresponding to a first authorized key followed by a signal corresponding to the master key (and the signal for the master key is received within a predetermined amount of time after receiving the signal corresponding to the first key), the microprocessor 88 in box 220 removes the first key code from the authorized key codes stored in memory 98.

Thus, it is easy to update the authorized key codes in memory 98 at any time, including after the electronic lock has been installed and in use for a period of time. It is only necessary to use the master key in combination with the keys which are desired to be removed from or added to the authorized key codes in memory. The authorized key codes in the memory 98 of an installed lock may be updated by simply touching the key detector 90 with the keys which should be added to or removed from the memory in sequence with the master key. It is not necessary to reprogram the lock by downloading new programming or files of authorized key codes to the microprocessor 88 or memory 98. The key management system thus greatly reduces the complexity of storing authorized keys in the memory of the lock, and updating the authorized key codes in the memory periodically.

In addition to adding or deleting authorized keys from memory, the master key may be used to control other lock functions, such as accessing the memory, opening the lock at specified times, turning off an alarm, etc. Such functions may not be accessible to the other authorized keys which are not a master key.

In a preferred embodiment, the key management system uses the touch memory button keys described in connection with the locking mechanism. These keys each have a unique serial number, or key code, so that each key provides a unique key code. Thus, once a first key has been detected, there is only a single key which can be the master key.

While the key management system may be used in connection with the electronic lock 10 of the present invention, it also finds utility in other electronic access control devices which utilize electronic keys and/or key codes. Thus, the key management system could be used with any kind of electronic access control device that uses a computer system to track keys and/or key codes. It is only necessary for the system to receive signals corresponding to key codes for particular keys. It is preferred that each key have a unique code. However, the system may be used with a set of keys in which several keys have the same code.

Figure 12:
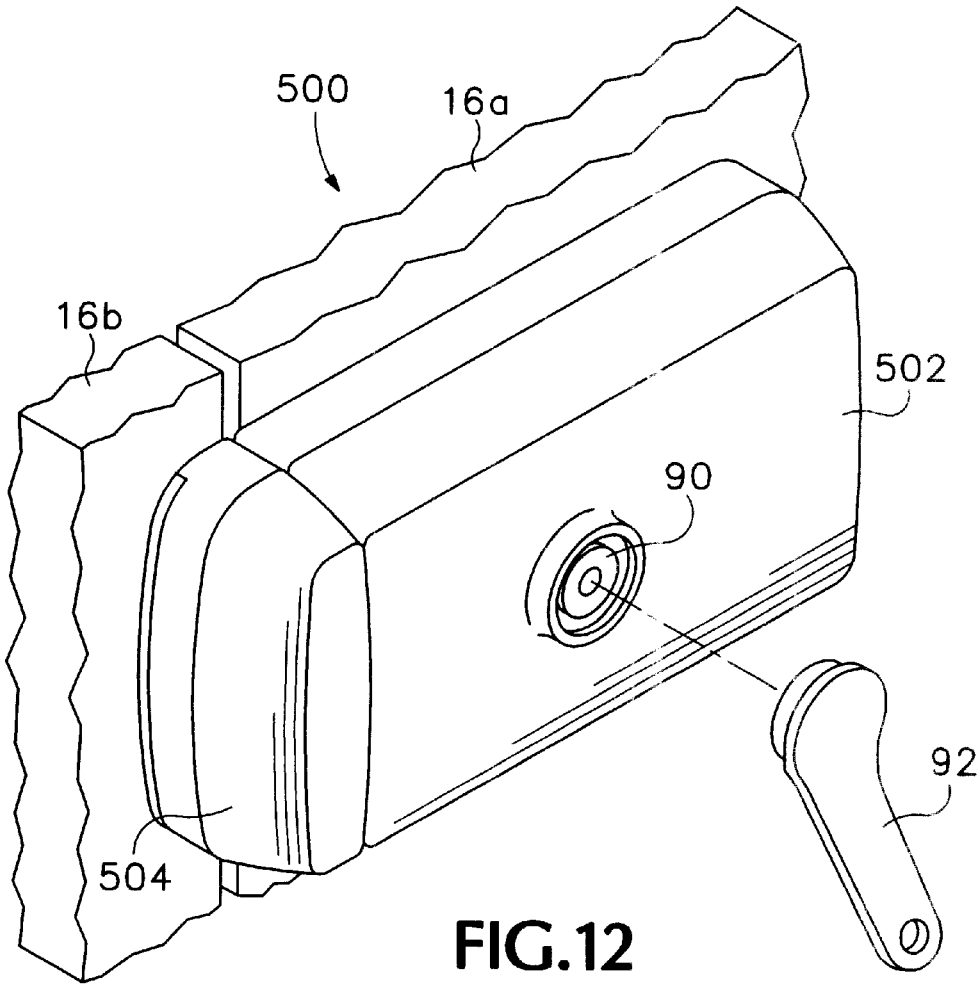
FIG. 12 shows another exemplary embodiment of an electronic access control device of the present invention.

In addition, the key management system could be used with systems that do not include a locking mechanism but do use keys and/or key codes to authorize access. Referring to FIG. 12, in one such system 500 a door unit 502 containing a key detector 90 and a computer system may be used with a stationary unit 504. The door unit contains the key management system of the present invention. The door unit 502 contains a proximity detector (not shown) to detect when the door unit 502 is moved relative to the stationary unit 502. The key management system is used to determine whether movement of the door unit 502 relative to the stationary unit 504 is authorized. If an authorized key is detected, the door unit 502 may be moved relative to the stationary unit 504 without an alarm sounding. However, if an authorized key is not detected, an alarm in the door unit 502 will sound in response to unauthorized movement of the door unit 502 relative to the stationary unit 504.

Alternatively, the key management system could be used with an appliance or device to which it is desired to restrict access, such as a television or a computer, by controlling the power to the device with a control access device. In other words, the key management system of the present invention may be used in any device in which a computer system controls or regulates access to or use of the device and in which the computer system will allow use or access of the device in response to a signal from an authorized key.

Lock Functions

The electronic lock also includes other components which are useful to operation of the electronic lock but are not necessary. The electronic lock 10 may include an LED 130 which may be used to indicate the status of the lock, such as that the electronic lock is on, that an authorized key has been detected and that the lock may be opened, or that the battery power is low. The electronic lock 10 may also include a beeper 132 to similarly communicate the status of the lock. The beeper 132 may be used to communicate, for example, when a master key has been detected, when an authorized key is detected, when a key code has been added to the authorized key codes in memory, and when a key has been deleted. The beeper 132 may also be used to sound an alarm in response to an attempt to open the electronic lock 10 by moving the locking member 24 without first using an authorized key. This is shown in box 310 of FIG. 15. In box 308, after determining that the switch 86 has been open for more than one second, the microprocessor in box 88 causes the beeper 132 to sound an alarm.

The electronic lock 10 may also include a system for keeping track of events. The electronic lock 10 may have a clock 134 which is set to the current time when the lock is first initialized. The microprocessor 88 stores in the memory 98 each key code detected by the key detector 90. Thus, the microprocessor 88 stores attempts to use both authorized keys and unauthorized keys. For each event, the microprocessor 88 may store other information, such as whether the electronic lock 10 was opened, when the lock 10 was locked, whether an error occurred in a lock function, or whether an attempt was made to open the lock 10 without an authorized key.

Data may be retrieved from or sent to the memory 98 in a variety of ways. For example, data may be transmitted using an infra-red communication system, such as those which operate in conformance with IRDA standards. The electronic lock 10 may have an emitting diode 136 and transmitting diode 138 to allow infrared communication with the microprocessor 88. Data may also be communicated over a cable using an RS232 communication standard. For example, in electronic lock 10 the key detector 90 also serves to allow communication with external devices using an RS232 communication protocol. The electronic lock therefore may be used to receive or send data to a personal computer, such as, for example, a Palm Pilot™ sold by 3COM®, which includes infrared communication capabilities and the ability to communicate over a cable. Data may also be transmitted using any other standard method for transmitting digital information.

Figure 16:
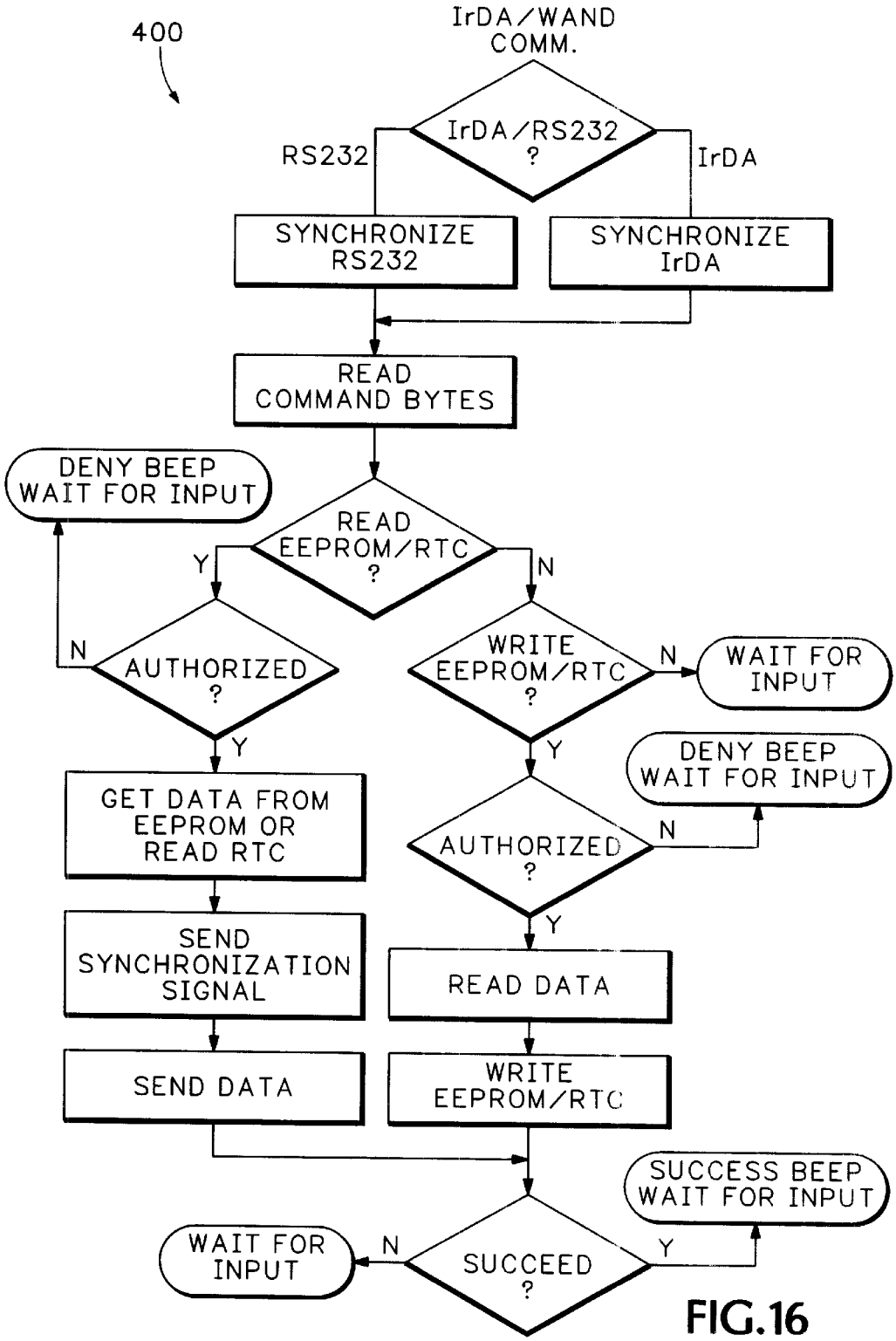
FIG. 16 shows a flow chart for an exemplary data communication method.

Flow charts showing the operation of an exemplary embodiment of an electronic lock are shown in FIGS. 14–16. FIG. 14 is a flowchart for an exemplary method of detecting a device such as a communication device or a key, and in response either performing steps from the key management system or allowing data communication. FIG. 15 is a flowchart for an exemplary method of determining whether, in response to a signal from the switch 86, to sound an alarm or to open the lock. FIG. 16 is a flowchart for an exemplary method of transmitting data to and from the memory of the electronic lock from either an RS232 port, such as through key detector 90, or an infra-red port, such as the infra-red LEDs 136, 138.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electronic access control device, comprising:

(a) a movable locking member;

(b) a latch member movable between an open position and a locked position, said latch member in said locked position interfering with movement of said locking member;

(c) an electrical unit operable to control said latch member and connected to a power supply;

(d) a movement detector that generates a first signal in response to movement of said locking member;

(e) a key detector that generates a second signal in response to detecting a key; and (f) said power supply directing current in said electrical unit in one direction to increase resistance to movement of said locking member in response to said first signal, and said power supply directing current in said electrical unit in an opposite direction to decrease resistance to movement of said locking member in response to said second signal.

2. The electronic access control device of claim 1, further including a releasing mechanism to move said latch member to said open position when current flows in said electrical unit in response to said second signal.

3. The electronic access control device of claim 2 wherein said releasing mechanism is a spring.

4. The electronic access control device of claim 1, further including an anti-releasing mechanism that urges said latch member toward said locked position.

5. The electronic access control device of claim 4 wherein said anti-releasing mechanism is a spring.

6. The electronic access control device of claim 4, further including a releasing mechanism to move said latch member to said open position when current flows in said electrical unit in response to said second signal.

7. The electronic access control device of claim 1 wherein said locking member, said latch member, said electrical unit, and said power supply are housed in an enclosure comprised of at least two parts, said two parts being matingly engageable with one another.

8. The electronic access control device of claim 1, further comprising a key management system wherein a first key detected by said key detector becomes a master key.

9. The electronic access control device of claim 8 wherein said key management system stores a plurality of authorized key codes, and said key management system adds another key code to said authorized key codes in response to receiving from said key detector a signal corresponding to said master key and another signal corresponding to another key.

10. The electronic access control device of claim 1 wherein said electrical unit is an electric motor.

11. An electronic access control device, comprising:

(a) a movable locking member;

(b) a locking mechanism operable to control said locking member;

(c) a movement detector that generates a first condition in response to movement of said locking member;

(d) a key detector that generates a second condition in response to detecting a key; and (e) said locking mechanism increasing resistance to movement of said locking member in response to said first condition, and said locking mechanism decreasing resistance to movement of said locking member in response to said second condition.

12. The electronic access control device of claim 11, further including an anti-releasing mechanism operable with said locking mechanism to increase resistance to movement of said locking member.

13. The electronic access control device of claim 11 wherein said locking mechanism includes an electric motor.

14. The electronic access control device of claim 11 wherein said locking member and said locking mechanism are housed in an enclosure comprised of at least two parts, said two parts being matingly engageable with one another.

15. The electronic access control device of claim 11, further comprising a key management system wherein a first key detected by said key detector becomes a master key.

16. The electronic access control device of claim 15, wherein said key management system stores a plurality of authorized key codes, and said key management system adds another key code to said authorized key codes in response to receiving from said key detector a signal corresponding to said master key and another signal corresponding to another key.

* * * * *

US006564600C1

(12) EX PARTE REEXAMINATION CERTIFICATE (9888th)

United States Patent

Davis

(10) Number: US 6,564,600 C1

(45) Certificate Issued: Oct. 21, 2013

(54) ELECTRONIC ACCESS CONTROL DEVICE

(75) Inventor: Paul R. Davis, Corvallis, OR (US)

(73) Assignee: Videx, Inc., Corvallis, OR (US)

Reexamination Request:
No. 90/012,763, Feb. 8, 2013

Reexamination Certificate for:

| | |
|---|---|
| Patent No.: | **6,564,600** |
| Issued: | **May 20, 2003** |
| Appl. No.: | **09/499,556** |
| Filed: | **Feb. 7, 2000** |

Related U.S. Application Data

(63) Continuation-in-part of application No. 09/264,246, filed on Mar. 8, 1999, now abandoned.

(51) Int. Cl.
*E05B 47/06* (2006.01)

(52) U.S. Cl.
USPC ..... 70/277; 70/278.2; 70/278.7; 70/283

(58) Field of Classification Search
None
See application file for complete search history.

(56) References Cited

To view the complete listing of prior art documents cited during the proceeding for Reexamination Control Number 90/012,763, please refer to the USPTO's public Patent Application Information Retrieval (PAIR) system under the Display References tab.

*Primary Examiner* — Jeffrey R Jastrzab

(57) ABSTRACT

An electronic access control device has a movable locking member. A locking mechanism is operable to control the locking member. A movement detector generates a first condition in response to movement of the locking member. A key detector generates a second condition in response to detecting a key. The locking mechanism increases resistance to movement of the locking member in response to the first condition, and decreases resistance to movement of the locking mechanism in response to the second condition.

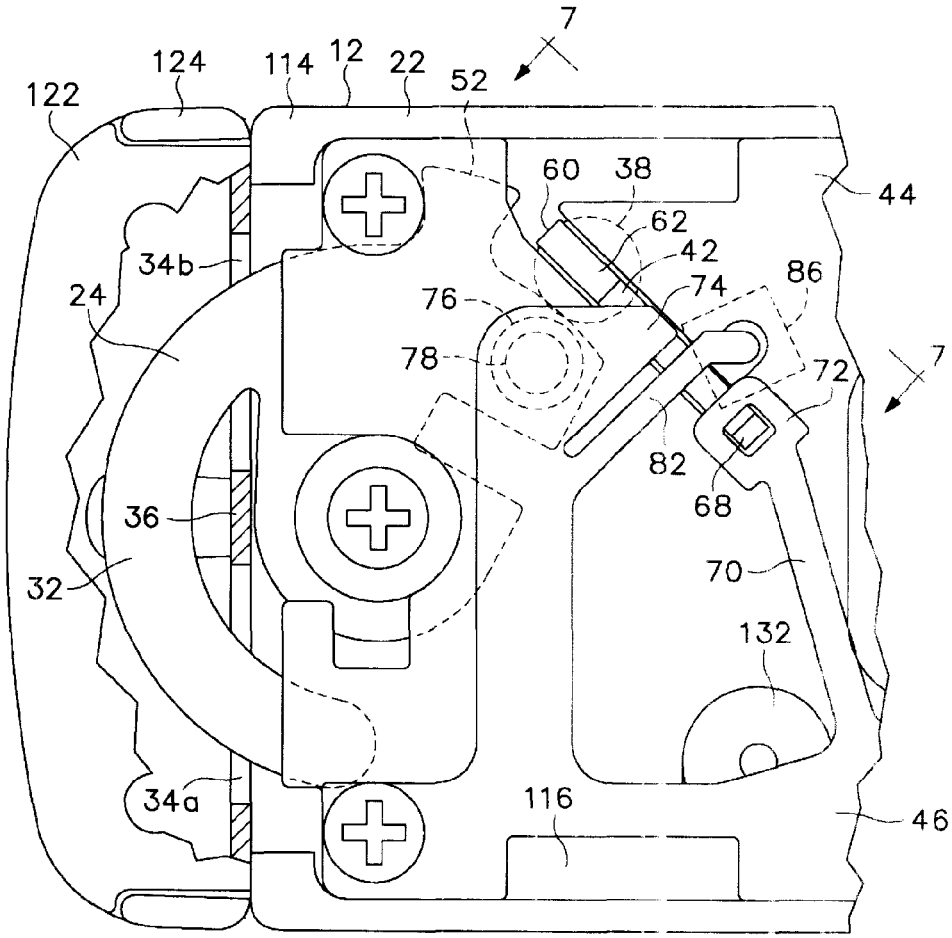

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 11 are cancelled.

Claims 2, 4, 7, 10 and 12-14 are determined to be patentable as amended.

Claim 6, dependent on an amended claim, is determined to be patentable.

New claims 17-108 are added and determined to be patentable.

Claims 3, 5, 8, 9, 15 and 16 were not reexamined.

2. The electronic access control device of claim [1] *107*, further including a releasing mechanism to move said latch member to said open position when current flows in said electrical unit in response to said second signal.

4. The electronic access control device of claim [1] *107*, further including an anti-releasing mechanism that urges said latch member toward said locked position.

7. The electronic access control device of claim [1] *107* wherein said locking member, said latch member, said electrical unit, and said power supply are housed in an enclosure comprised of at least two parts, said two parts being matingly engageable with one another.

10. The electronic access control device of claim [1] *107* wherein said electrical unit is an electric motor.

12. The electronic access control device of claim [11] *108*, further including an anti-releasing mechanism operable with said locking mechanism to increase resistance to movement of said locking member.

13. The electronic access control device of claim [11] *108* wherein said locking mechanism includes an electric motor.

14. The electronic access control device of claim [11] *108* wherein said locking member and said locking mechanism are housed in an enclosure comprised of at least two parts, said two parts being matingly engageable with one another.

*17. The electronic access control device of claim 107, wherein the key detector is an electronic key detector that comprises:*

*a key detector module configured to determine a key code corresponding to the detected key;*

*a memory configured to store key codes associated with keys which are authorized to unlock the electronic access control device;*

*a data processor configured to compare the key code corresponding to the detected key with the key codes associated with authorized keys, wherein the data processor generates the second signal when the data processor identifies a match.*

*18. The electronic access control device of claim 107, wherein the key detector is an electronic key detector that comprises a memory configured to store key codes associated with keys which are authorized to unlock the electronic access control device.*

*19. The electronic access control device of claim 18, wherein the key detector is configured to add a particular key code associated with a particular key to the memory based on the key detector detecting the particular key.*

*20. The electronic access control device of claim 18, wherein the key detector is configured to add a particular key code associated with a particular key to the memory based on the key detector wirelessly detecting the particular key.*

*21. The electronic access control device of claim 19, wherein the key detector is configured to issue an audio or visual alert when the particular key code is added to the memory.*

*22. The electronic access control device of claim 19, wherein the key detector is configured to detect the particular key wirelessly.*

*23. The electronic access control device of claim 107, wherein the key detector is configured to detect a key code associated with the key wirelessly from an external device that includes an integrated circuit.*

*24. The electronic access control device of claim 18, wherein the key detector is configured to add a particular key code associated with a particular key to the memory based only on the key detector detecting a master key and the key detector detecting the particular key.*

*25. The electronic access control device of claim 18, wherein multiple physical keys are associated with a particular key code stored in the memory.*

*26. The electronic access control device of claim 107, wherein the key detector comprises an integrated unit having both a processor and a memory.*

*27. The electronic access control device of claim 107, further comprising a key management system, wherein the key management system is configured to store a plurality of authorized key codes, and wherein said key management system is configured to delete a particular authorized key code in response to receiving from said key detector a signal corresponding to the particular key code and another signal corresponding to a master key.*

*28. The electronic access control device of claim 107, further comprising an event logging module configured to store data associated with interactions with the electronic access control device;*

*wherein the event logging module is configured to store data associated with a tampering event.*

*29. The electronic access control device of claim 28, wherein the event logging module is configured to identify the tampering event based on the first signal.*

*30. The electronic access control device of claim 107, wherein the first signal is generated in response to movement associated with a tampering event.*

*31. The electronic access control device of claim 107, wherein the first signal is generated in response to a button being released.*

*32. The electronic access control device of claim 107, further comprising an event logging module configured to store data associated with interactions with the electronic access control device;*

*wherein the event logging module is configured to store data associated with the generation of the first signal that is generated in response to movement of said locking member.*

*33. The electronic access control device of claim 107, further comprising an alarm that is configured to activate when the first signal is generated for more than a predetermined period of time.*

*34. The electronic access control device of claim 107, wherein the key detector comprises:*

*a status alert module configured to emit a status alert when a master key has been detected, when an authorized key is detected, when a key code has been added to a set of authorized key codes, or when a key code has been deleted from the set of authorized key codes.*

*35. The electronic access control device of claim 107, wherein the key detector comprises:*

*a status alert module configured to emit status alerts when a master key has been detected, when an authorized key is detected, when a key code has been added to a set of authorized key codes, and when a key code has been deleted from the set of authorized key codes.*

*36. The electronic access control device of claim 107, wherein the key detector comprises:*

*a first status alert module configured to emit status alerts when a master key has been detected; and*

*a second status alert module configured to emit status alerts when an authorized key is detected, wherein the second status alert differs from the first status alert.*

*37. The electronic access control device of claim 34, wherein the status alert module includes a light emitting diode or a beeper.*

*38. The electronic access control device of claim 107, further comprising an event logging module configured to store data associated with interactions with the electronic access control device.*

*39. The electronic access control device of claim 38, wherein the event logging module is configured to store data associated with each attempt to unlock the electronic access control device using an authorized key.*

*40. The electronic access control device of claim 38, wherein the event logging module is configured to store data associated with each attempt to unlock the electronic access control device using an unauthorized key.*

*41. The electronic access control device of claim 38, wherein the event logging module is configured to store data associated with a time of each attempt to unlock the electronic access control device.*

*42. The electronic access control device of claim 38, wherein the event logging module is configured to wirelessly communicate the data associated with interactions with the electronic access control device to a receiving device.*

*43. The electronic access control device of claim 107, further comprising an event logging module configured to store data associated with interactions with the electronic access control device, wherein the event logging module is configured to store data associated with:*

*each attempt to unlock the electronic access control device using an authorized key;*

*each attempt to unlock the electronic access control device using an unauthorized key;*

*a time of each attempt to unlock the electronic access control device; and wherein the event logging module is further configured to wirelessly communicate the data associated with interactions with the electronic access control device to a receiving device.*

*44. The electronic access control device of claim 107, further comprising:*

*an enclosure comprised of at least a base member and a housing detachably matingly engagable with one another;*

*said base member having mounting members that attach said base member to a surface; and*

*a catch mechanism cooperating with said housing and said base member that limits relative movement therebetween when said housing is matingly engaged with said base member to form said enclosure and said locking member is in a locked position.*

*45. The electronic access control device of claim 44, further including a strike unit, and said enclosure defining one or more openings, each of said openings of said enclosure facing at least one of the surface and said strike unit when said locking member is received by said strike unit.*

*46. The electronic access control device of claim 44, wherein said locking member is arcuate.*

*47. The electronic access control device of claim 44, wherein said locking member in said locked position substantially surrounds a portion of said strike unit.*

*48. The electronic access control device of claim 107, further comprising a microprocessor configured to control the electrical unit and the power supply.*

*49. The electronic access control device of claim 48, wherein the microprocessor is configured to control the power supply to direct current based on both of the first signal and the second signal.*

*50. The electronic access control device of claim 49, wherein the microprocessor is configured to initiate an authorized access check upon receiving the first signal, wherein the authorized access check determines whether the second signal indicates that an authorized key has been detected by the key detector.*

*51. The electronic access control device of claim 50, wherein when the second signal indicates that an authorized key has been detected, the microprocessor is configured to direct current in said electrical unit to decrease resistance to movement of said locking member; and*

*wherein when the second signal indicates that no authorized key has been detected, the microprocessor is configured to direct current in said electrical unit to increase resistance to movement of said locking member.*

*52. The electronic access control device of claim 51, wherein directing said current to increase resistance is configured to increase a total magnetic attraction of a magnet and coil of wire combination within the electrical unit.*

*53. The electronic access control device of claim 51, wherein directing said current to decrease resistance is configured to cancel a total magnetic attraction of a magnet and coil of wire combination within the electrical unit.*

*54. The electronic access control device of claim 107, wherein the electrical unit comprises a solenoid, wherein the solenoid comprises a permanent magnet and a coil of wire.*

*55. The electronic access control device of claim 54, wherein the coil of wire is positioned so that an electric current passing through the coil induces a magnetic field that is either aligned in the same direction as a magnetic field of the permanent magnet or aligned in the opposite direction of the magnetic field of the permanent magnet, depending on the direction of the current flow.*

*56. The electronic access control device of claim 55, wherein directing said current to increase resistance is configured to increase a total magnetic attraction of the permanent magnet and coil of wire combination to the latch member.*

*57. The electronic access control device of claim 55, wherein directing said current to decrease resistance is configured to substantially cancel a total magnetic attraction of the permanent magnet and coil of wire combination to the latch member.*

*58. The electronic access control device of claim 55, wherein the solenoid is positioned beneath the latch member, wherein the solenoid is configured to attract the latch member to the locked position during a resecuring operation.*

*59. The electronic access control device of claim 58, wherein the locking member rotates in a first plane, wherein when in the locked position, a portion of the latch member is in the first plane and interferes with rotation of the locking member.*

*60. The electronic access control device of claim 107, wherein the key detector is an electronic key detector that comprises a memory configured to store key codes associated with keys which are authorized to unlock the electronic access control device;*

*wherein the key detector is configured to detect a key code associated with the key wirelessly from an external device that includes an integrated circuit;*

*wherein multiple physical keys are associated with a particular key code stored in the memory;*

*wherein the key detector is configured to add a particular key code associated with a particular key to the memory based on the key detector detecting the particular key;*

*wherein the electronic access control device further comprises an event logging module configured to store data associated with interactions with the electronic access control device; and*

*wherein the event logging module is configured to wirelessly communicate the data associated with interactions with the electronic access control device to a receiving device.*

*61. The electronic access control device of claim 107, wherein the key detector is an electronic key detector that comprises: a key detector module configured to determine a key code corresponding to the detected key, a memory configured to store key codes associated with keys which are authorized to unlock the electronic access control device, and a data processor configured to compare the key code corresponding to the detected key with the key codes associated with authorized keys, wherein the data processor is configured to generate the second signal when the data processor identifies a match;*

*wherein the key detector is configured to detect a key code associated with the key wirelessly from an external device that includes an integrated circuit;*

*wherein multiple physical keys are associated with a particular key code stored in the memory;*

*wherein the key detector is configured to add a particular key code associated with a particular key to the memory based on the key detector detecting the particular key;*

*wherein the electronic access control device further comprises an event logging module configured to store data associated with interactions with the electronic access control device;*

*wherein the event logging module is configured to store data associated with each attempt to open the electronic access control device;*

*wherein the event logging module is configured to store data associated with the each attempt to open the electronic access control device using an authorized key;*

*wherein the event logging module is configured to store data associated with the each attempt to open the electronic access control device using an unauthorized key;*

*wherein the event logging module is configured to store data associated with a time of each attempt to open the electronic access control device;*

*wherein the event logging module is configured to store data associated with a tampering event;*

*wherein the event logging module is configured to wirelessly communicate the data associated with interactions with the electronic access control device to a receiving device;*

*wherein the key detector further comprises a status alert module that is configured to emit a status alert when a master key has been detected, when an authorized key is detected, when a key code has been added to a set of authorized key codes, or when a key code has been deleted from the set of authorized key codes; and*

*wherein the status alert module includes a light emitting diode or a beeper.*

*62. The electronic access control device of claim 108, wherein the key detector is an electronic key detector that comprises:*

*a key detector module configured to determine a key code corresponding to the detected key;*

*a memory configured to store key codes associated with keys which are authorized to unlock the electronic access control device;*

*a data processor configured to compare the key code corresponding to the detected key with the key codes associated with authorized keys, wherein the data processor generates the second condition when the data processor identifies a match.*

*63. The electronic access control device of claim 108, wherein the key detector is an electronic key detector that comprises a memory configured to store key codes associated with keys which are authorized to unlock the electronic access control device.*

*64. The electronic access control device of claim 63, wherein the key detector is configured to add a particular key code associated with a particular key to the memory based on the key detector detecting the particular key.*

*65. The electronic access control device of claim 63, wherein the key detector is configured to add a particular key code associated with a particular key to the memory based on the key detector wirelessly detecting the particular key.*

*66. The electronic access control device of claim 64, wherein the key detector is configured to issue an audio or visual alert when the particular key code is added to the memory.*

*67. The electronic access control device of claim 64, wherein the key detector is configured to detect the particular key wirelessly.*

*68. The electronic access control device of claim 108, wherein the key detector is configured to detect a key code associated with the key wirelessly from an external device that includes an integrated circuit.*

*69. The electronic access control device of claim 63, wherein the key detector is configured to add a particular key code associated with a particular key to the memory based only on the key detector detecting a master key and the key detector detecting the particular key.*

*70. The electronic access control device of claim 63, wherein multiple physical keys are associated with a particular key code stored in the memory.*

*71. The electronic access control device of claim 108, wherein the key detector comprises an integrated unit having both a processor and a memory.*

*72. The electronic access control device of claim 108, further comprising a key management system, wherein the key management system is configured to store a plurality of authorized key codes, and wherein said key management system is configured to delete a particular authorized key code in response to receiving from said key detector a signal corresponding to the particular key code and another signal corresponding to a master key.*

*73. The electronic access control device of claim 108, further comprising an event logging module configured to store data associated with interactions with the electronic access control device;*

*wherein the event logging module is configured to store data associated with a tampering event.*

*74. The electronic access control device of claim 73, wherein the event logging module is configured to identify the tampering event based on the first condition.*

*75. The electronic access control device of claim 108, wherein the first condition is generated in response to movement associated with a tampering event.*

*76. The electronic access control device of claim 108, wherein the first condition is generated in response to a button being released.*

*77. The electronic access control device of claim 108, further comprising an event logging module configured to store data associated with interactions with the electronic access control device;*

*wherein the event logging module is configured to store data associated with the generation of the first condition that is generated in response to movement of said locking member.*

*78. The electronic access control device of claim 108, further comprising an alarm that is configured to activate when the first condition is generated for more than a predetermined period of time.*

*79. The electronic access control device of claim 108, wherein the key detector comprises:*

*a status alert module configured to emit a status alert when a master key has been detected, when an authorized key is detected, when a key code has been added to a set of authorized key codes, or when a key code has been deleted from the set of authorized key codes.*

*80. The electronic access control device of claim 108, wherein the key detector comprises:*

*a status alert module configured to emit status alerts when a master key has been detected, when an authorized key is detected, when a key code has been added to a set of authorized key codes, and when a key code has been deleted from the set of authorized key codes.*

*81. The electronic access control device of claim 108, wherein the key detector comprises:*

*a first status alert module configured to emit status alerts when a master key has been detected; and*

*a second status alert module configured to emit status alerts when an authorized key is detected, wherein the second status alert differs from the first status alert.*

*82. The electronic access control device of claim 79, wherein the status alert module includes a light emitting diode or a beeper.*

*83. The electronic access control device of claim 108, further comprising an event logging module configured to store data associated with interactions with the electronic access control device.*

*84. The electronic access control device of claim 83, wherein the event logging module is configured to store data associated with each attempt to unlock the electronic access control device using an authorized key.*

*85. The electronic access control device of claim 83, wherein the event logging module is configured to store data associated with each attempt to unlock the electronic access control device using an unauthorized key.*

*86. The electronic access control device of claim 83, wherein the event logging module is configured to store data associated with a time of each attempt to unlock the electronic access control device.*

*87. The electronic access control device of claim 83, wherein the event logging module is configured to wirelessly communicate the data associated with interactions with the electronic access control device to a receiving device.*

*88. The electronic access control device of claim 108, further comprising an event logging module configured to store data associated with interactions with the electronic access control device, wherein the event logging module is configured to store data associated with:*

*each attempt to unlock the electronic access control device using an authorized key;*

*each attempt to unlock the electronic access control device using an unauthorized key;*

*a time of each attempt to unlock the electronic access control device; and wherein the event logging module is further configured to wirelessly communicate the data associated with interactions with the electronic access control device to a receiving device.*

*89. The electronic access control device of claim 108, further comprising:*

*an enclosure comprised of at least a base member and a housing detachably matingly engagable with one another;*

*said base member having mounting members that attach said base member to a surface; and*

*a catch mechanism cooperating with said housing and said base member that limits relative movement therebetween when said housing is matingly engaged with said base member to form said enclosure and said locking member is in a locked position.*

*90. The electronic access control device of claim 89, further including a strike unit, and said enclosure defining one or more openings, each of said openings of said enclosure facing at least one of the surface and said strike unit when said locking member is received by said strike unit.*

*91. The electronic access control device of claim 89, wherein said locking member is arcuate.*

*92. The electronic access control device of claim 89, wherein said locking member in said locked position substantially surrounds a portion of said strike unit.*

*93. The electronic access control device of claim 108, further comprising:*

*an electrical unit operable to control said locking mechanism and connected to a power supply, wherein said electrical unit is configured to exert a rotational force on the locking mechanism during a locking member securing operation; and*

*a microprocessor configured to control the electrical unit and the power supply.*

*94. The electronic access control device of claim 93, wherein the microprocessor is configured to control the power supply to direct current based on both of the first condition and the second condition.*

*95. The electronic access control device of claim 94, wherein the microprocessor is configured to initiate an authorized access check upon receiving the first condition, wherein the authorized access check determines whether the second condition indicates that an authorized key has been detected by the key detector.*

*96. The electronic access control device of claim 95, wherein when the second condition indicates that an authorized key has been detected, the microprocessor is configured to direct current in said electrical unit to decrease resistance to movement of said locking member; and*

*wherein when the second condition indicates that no authorized key has been detected, the microprocessor is*

*configured to direct current in said electrical unit to increase resistance to movement of said locking member.*

*97. The electronic access control device of claim 96, wherein directing said current to increase resistance is configured to increase a total magnetic attraction of a magnet and coil of wire combination within the electrical unit.*

*98. The electronic access control device of claim 96, wherein directing said current to decrease resistance is configured to cancel a total magnetic attraction of a magnet and coil of wire combination within the electrical unit.*

*99. The electronic access control device of claim 108, further comprising:*

*an electrical unit operable to control said locking mechanism and connected to a power supply, wherein said electrical unit is configured to exert a rotational force on the locking mechanism during a locking member securing operation, wherein the electrical unit comprises a solenoid, and wherein the solenoid comprises a permanent magnet and a coil of wire.*

*100. The electronic access control device of claim 99, wherein the coil of wire is positioned so that an electric current passing through the coil induces a magnetic field that is either aligned in the same direction as a magnetic field of the permanent magnet or aligned in the opposite direction of the magnetic field of the permanent magnet, depending on the direction of the current flow.*

*101. The electronic access control device of claim 100, wherein said power supply directs current in said electrical unit in one direction to increase resistance to movement of said locking member in response to said first condition by said electrical unit exerting a rotational force on the locking mechanism that moves the locking mechanism and returns the locking member to a secured state, wherein said power supply directs current in said electrical unit in an opposite direction to decrease resistance to movement of said locking member in response to said second condition, and wherein directing said current to increase resistance is configured to increase a total magnetic attraction of the permanent magnet and coil of wire combination to the locking mechanism.*

*102. The electronic access control device of claim 100, wherein said power supply directs current in said electrical unit in one direction to increase resistance to movement of said locking member in response to said first condition by said electrical unit exerting a rotational force on the locking mechanism that moves the locking mechanism and returns the locking member to a secured state, wherein said power supply directs current in said electrical unit in an opposite direction to decrease resistance to movement of said locking member in response to said second condition, and wherein directing said current to decrease resistance is configured to substantially cancel a total magnetic attraction of the permanent magnet and coil of wire combination to the locking mechanism.*

*103. The electronic access control device of claim 100, wherein said locking mechanism is movable between an open position and a locked position, said locking mechanism in said locked position interfering with movement of said locking member, wherein the solenoid is positioned beneath the locking mechanism, and wherein the solenoid is configured to attract the locking mechanism to the locked position during a resecuring operation.*

*104. The electronic access control device of claim 103, wherein the locking member rotates in a first plane, wherein when in the locked position, a portion of the locking mechanism is in the first plane and interferes with rotation of the locking member.*

*105. The electronic access control device of claim 108, wherein the key detector is an electronic key detector that comprises a memory configured to store key codes associated with keys which are authorized to unlock the electronic access control device;*

*wherein the key detector is configured to detect a key code associated with the key wirelessly from an external device that includes an integrated circuit;*

*wherein multiple physical keys are associated with a particular key code stored in the memory;*

*wherein the key detector is configured to add a particular key code associated with a particular key to the memory based on the key detector detecting the particular key;*

*wherein the electronic access control device further comprises an event logging module configured to store data associated with interactions with the electronic access control device; and*

*wherein the event logging module is configured to wirelessly communicate the data associated with interactions with the electronic access control device to a receiving device.*

*106. The electronic access control device of claim 108, wherein the key detector is an electronic key detector that comprises: a key detector module configured to determine a key code corresponding to the detected key, a memory configured to store key codes associated with keys which are authorized to unlock the electronic access control device, and a data processor configured to compare the key code corresponding to the detected key with the key codes associated with authorized keys, wherein the data processor is configured to generate the second condition when the data processor identifies a match;*

*wherein the key detector is configured to detect a key code associated with the key wirelessly from an external device that includes an integrated circuit;*

*wherein multiple physical keys are associated with a particular key code stored in the memory;*

*wherein the key detector is configured to add a particular key code associated with a particular key to the memory based on the key detector detecting the particular key;*

*wherein the electronic access control device further comprises an event logging module configured to store data associated with interactions with the electronic access control device;*

*wherein the event logging module is configured to store data associated with each attempt to open the electronic access control device;*

*wherein the event logging module is configured to store data associated with the each attempt to open the electronic access control device using an authorized key;*

*wherein the event logging module is configured to store data associated with the each attempt to open the electronic access control device using an unauthorized key;*

*wherein the event logging module is configured to store data associated with a time of each attempt to open the electronic access control device;*

*wherein the event logging module is configured to store data associated with a tampering event;*

*wherein the event logging module is configured to wirelessly communicate the data associated with interactions with the electronic access control device to a receiving device;*

*wherein the key detector further comprises a status alert module that is configured to emit a status alert when a master key has been detected, when an authorized key is detected, when a key code has been added to a set of authorized key codes, or when a key code has been deleted from the set of authorized key codes; and*

*wherein the status alert module includes a light emitting diode or a beeper.*

*107. An electronic access control device, comprising:*

(*a*) *a movable locking member;*

(*b*) *a latch member movable between an open position and a locked position, said latch member in said locked position interfering with movement of said locking member;*

(*c*) *an electrical unit operable to control said latch member and connected to a power supply, wherein said electrical unit is configured to exert a rotational force on the latch member during a locking member securing operation;*

(*d*) *a movement detector that generates a first signal in response to movement of said locking member, wherein the movement detector detects a change in relative positions of the latch member and the locking member, wherein the movement detector comprises a force sensing switch that is configured to determine whether the latch member has been affected by an external amount of force that is sufficient to trigger a resecuring operation based on a threshold, wherein the locking member is in an unsecured state when the first signal is generated;*

(*e*) *a key detector that generates a second signal in response to detecting a key; and*

(*f*) *said power supply directing current in said electrical unit in one direction to increase resistance to movement of said locking member in response to said first signal by said electrical unit exerting a rotational force on the latch member that moves the latch member and returns the locking member to a secured state, and said power supply directing current in said electrical unit in an opposite direction to decrease resistance to movement of said locking member in response to said second signal.*

*108. An electronic access control device, comprising:*

(*a*) *a movable locking member;*

(*b*) *a locking mechanism operable to control said locking member;*

(*c*) *a movement detector that generates a first condition in response to movement of said locking member, wherein the movement detector detects a change in relative positions of the locking mechanism and the locking member, wherein the movement detector comprises a force sensing switch that is configured to determine whether the locking mechanism has been affected by an external amount of force that is sufficient to trigger a resecuring operation based on a threshold, and wherein the locking member is in an unsecured state when the first condition is generated;*

(*d*) *a key detector that generates a second condition in response to detecting a key; and*

(*e*) *said locking mechanism increasing resistance to movement of said locking member in response to said first condition using an electrical unit to exert a rotational force on the locking mechanism that moves the locking mechanism and returns the locking member to a secured state, and said locking mechanism decreasing resistance to movement of said locking member in response to said second condition.*

* * * * *